US012582217B2

(12) United States Patent
Reid et al.

(10) Patent No.: US 12,582,217 B2
(45) Date of Patent: Mar. 24, 2026

(54) ADJUSTABLE BACKPACK

(71) Applicant: Amer Sports Canada Inc., North Vancouver (CA)

(72) Inventors: Lawrence C. Reid, Gibsons (CA); Christopher R. Hodgetts, Squamish (CA); Courtney A. Neray, Garibaldi Heights (CA); Marie-Alexandre Baribeau, North Vancouver (CA)

(73) Assignee: Amer Sports Canada Inc., North Vancouver (CA)

( * ) Notice: Subject to any disclaimer, the term of this patent is extended or adjusted under 35 U.S.C. 154(b) by 277 days.

(21) Appl. No.: 18/137,872

(22) Filed: Apr. 21, 2023

(65) Prior Publication Data

US 2024/0349871 A1 Oct. 24, 2024

(51) Int. Cl.
*A45F 3/04* (2006.01)

(52) U.S. Cl.
CPC ..... *A45F 3/047* (2013.01)

(58) Field of Classification Search
CPC ..... A45F 2003/025; A45F 2003/045; A45F 2003/122; A45F 2003/125; A45F 3/02; A45F 3/04; A45F 3/042; A45F 3/047; A45F 3/08; A45F 3/12
USPC ..... 224/631
See application file for complete search history.

(56) References Cited

U.S. PATENT DOCUMENTS 2,421,244 A * 5/1947 Daiber ..... A45F 3/08 224/656
4,811,768 A 3/1989 Williams
5,005,744 A 4/1991 Gleason
5,240,159 A 8/1993 Gregory
5,361,955 A 11/1994 Gregory
5,564,612 A 10/1996 Gregory
5,586,705 A 12/1996 Leonard
5,704,530 A 1/1998 Scherer
5,762,251 A 6/1998 Gleason
6,179,188 B1 1/2001 Gleason
7,431,184 B2 10/2008 Gregory
(Continued)

FOREIGN PATENT DOCUMENTS

DE 29502899 5/1995
DE 19932499 A1 2/2001
(Continued)

OTHER PUBLICATIONS

EP-1808092-A1 Translation, Von Dewitz, Jul. 18, 2007 (Year: 2007).*
(Continued)

*Primary Examiner* — Nathan J Newhouse
*Assistant Examiner* — Matthew T Theis
(74) *Attorney, Agent, or Firm* — Terence P. O'Brien; Todd A. Rathe

(57) ABSTRACT

A backpack may include a pack portion having a backside having a first slot and a frame having a second slot, wherein a flexible end portion of the shoulder strap passes through the first slot in the second slot and is adjustably connected to the frame to adjust a length of the flexible end portion of the shoulder strap that extends beyond the first slot. A backpack may include a hip belt having a rear portion connected to a frame, wherein the rear portion has left and right end portions that are repositionable at different angles relative to one another.

18 Claims, 25 Drawing Sheets

(56) References Cited

U.S. PATENT DOCUMENTS

| | | | | |
|---|---|---|---|---|
| 8,066,164 | B2 | 11/2011 | Gregory | |
| 8,876,568 | B2 | 11/2014 | Blenkarn et al. | |
| 8,893,940 | B2 * | 11/2014 | Green | A45F 3/08 224/604 |
| 9,272,187 | B2 | 3/2016 | Blenkarn et al. | |
| 9,427,625 | B2 | 8/2016 | Rose et al. | |
| 9,731,801 | B2 | 8/2017 | Blenkarn et al. | |
| 9,770,626 | B2 | 9/2017 | Rose et al. | |
| 10,004,320 | B2 | 6/2018 | Reid et al. | |
| 10,556,137 | B2 | 2/2020 | Rose | |
| 2006/0289589 | A1 | 12/2006 | Gregory | |
| 2007/0090137 | A1 | 4/2007 | Kim | |
| 2008/0035686 | A1 | 2/2008 | Gregory | |
| 2011/0309124 | A1 * | 12/2011 | Dubois | A45F 3/04 224/628 |

FOREIGN PATENT DOCUMENTS

| | | | | |
|---|---|---|---|---|
| EP | 574631 | A1 * | 12/1993 | A45F 3/04 |
| EP | 0748599 | A1 * | 12/1996 | |
| EP | 1808092 | A1 * | 7/2007 | A45F 3/047 |
| FR | 2818509 | A1 * | 6/2002 | A45F 3/04 |
| KR | 910001496 | Y1 * | 3/1991 | A45F 3/047 |
| WO | 2017024246 | | 2/2017 | |

OTHER PUBLICATIONS

FR-2818509-A1 Translation, Cecchinel W, Jun. 28, 2002 (Year: 2002).*

KR-910001496-Y1 Translation, Huber Hermann, Mar. 7, 1991 (Year: 1991).*

Image of a web page (https://www.granitegear.com/outdoor/backpacks/multi-day-backpacks/virga-series-packs/virga3-55-unisex.html) Granite Gear Virga3 55 Unisex Backpack image retrieved on Mar. 25, 2025.

* cited by examiner

ADJUSTABLE BACKPACK

BACKGROUND

Backpacks are used to carry loads along the back of a person wearing the backpack. Such backpacks often include a pack portion that provides an interior compartment for containing the load and shoulder straps that support the load across the person's shoulders. To inhibit unwanted deformation, such backpacks may be provided with stiffening frames. Backpacks designed to carry substantial loads or loads over long distances are often provided with hip belts attached to the stiffening frames, wherein the hip belts shift a portion of the load off of the shoulder straps to the hips of the person. For the best load transfer and the most comfort, some backpacks may have configurations that are customized based upon the particular anatomy of the person to wear the backpack.

BRIEF DESCRIPTION OF THE DRAWINGS

FIG. 42 illustrating two example lengths of the attached shoulder straps.

FIG. 43 illustrating two example lengths of the attached shoulder straps.

FIG. 45 illustrating pivoting of the example flaps to a position shown in broken lines.

Figure 1:
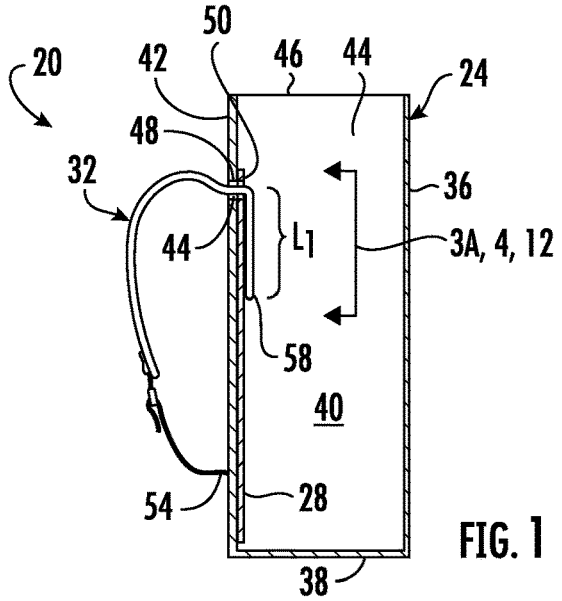
FIG. 1 is a sectional view illustrating portions of an example backpack with shoulder straps having a first extended length.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example adjustable backpacks that are adjustable to accommodate different anatomies to enhance load stability, load distribution and comfort. The example backpacks may comprise shoulder straps that have an adjustable length to accommodate different shoulder thicknesses. As result, particular portions of the shoulder straps or sternum straps, may be appropriately positioned relative to the neck and along the chest of the person wearing the backpack regardless of the person's particular anatomy.

In some implementations, the backpacks may comprise a pack portion comprising a backside and an inner compartment to accommodate a load. The backpacks may further comprise a frame connected to the pack portion between the backside and the inner compartment. The frame may comprise at least one rigid or semi rigid sheet. In some implementations, a gusset pocket formed between the backside and the inner compartment receives the sheet.

The backside of the pack portion may comprise a first slot while the sheet may comprise a second slot aligned with the first slot. The shoulder strap may comprise a flexible end portion that passes through the first slot and the second slot, wherein the shoulder strap is adjustably connectable to the frame to adjust a length of the flexible end portion of the shoulder strap that extends beyond the first slot. In some implementations, the flexible end portion of the shoulder strap has a first length extending beyond the first slot and a second length passing through the first slot and the second slot.

In some implementations, the second length may be at least 3.5 inches. In some implementations, flexible end portion of the shoulder strap may be joined to the frame at multiple locations, providing an adjustability of at least 3 inches, and in some implementations, up to or greater than 6 inches. In some implementations, a load stabilizing strap may be additionally provided, wherein the load stabilizing strap has a lower end connected to the shoulder strap and an upper end connected to the backside of the pack portion.

In some implementations, the shoulder strap is adjustably connectable to the frame by being releasably connectable to the frame at one of a plurality of available locations so as to adjust a length of the flexible end portion of the shoulder strap that extends beyond the first slot. In some implementations, the shoulder strap is adjustably connected to the frame by being releasably connectable to the frame by at least one hook and loop fastener. In some implementations, the hook and loop fastener is sufficiently large to provide a continuum of different locations at which shoulder strap may be releasably connected to the frame. In some implementations, the hook and loop fastener is sufficiently large such that the shoulder strap may be releasably connected to the frame at different angles.

In some implementations, the flexible end portion of the shoulder strap has components of a hook and loop fastener on both opposite faces. A first face of the shoulder strap has a first component of a first hook and loop fastener that connects to or engages a second component of the hook and loop fastener that is coupled to the frame. A second face of the shoulder strap has a first component of a second hook and loop fastener. In such implementations, the backpack may additionally include a flap coupled to the frame, the flap carrying a second component of the second hook and loop fastener. The flap may be pivoted such that the second component of the second hook and loop fastener engages in connects to the first component of the second hook and loop fastener carried on the second face of the flexible end portion of the shoulder strap. In this state, the flexible end portion of the shoulder strap is sandwiched between the flap and the frame and is connected to each of the flap and the frame for a secure connection to and retention of the shoulder strap to the frame.

In some implementations, the second component of the hook and loop fastener that is coupled to the frame comprises an enlarged patch, facilitating connection of the flexible end portion of the shoulder strap to the patch at a variety of different positions and angles. In some implementations, the backpack includes separate pivoting flaps (supporting a component of a hook and loop fastener) for each of the two shoulder straps. The two separate flaps facilitate independent release and connection of the individual shoulder straps to the frame. In some implementations, a series of spaced snaps or other mechanisms may be utilized in lieu of the hook and loop fasteners. For example, one or both sides of the flexible end portions of the shoulder straps may be provided with a series of snap components in place of the hook and loop fastener components, wherein the flaps and/or the frame have corresponding or mating series of snap components. In some implementations, the flap or flaps may be omitted.

In some implementations, the shoulder strap is adjustably connected to the frame by being releasably connectable to the frame by an arrangement of snap fasteners, wherein different portions or subsets of the snap fasteners are used when the shoulder strap is connected to the frame at different positions. In some implementations, the shoulder strap is adjustably connectable to the frame by having a portion that is adjustably passed through a buckle that is attached to the frame, wherein different regions of the flexible end portion may be releasably gripped by the buckle to alter a length of the flexible end portion of the shoulder strap that extends beyond the first slot.

In some implementations, the backpack may be provided with various indicators to indicate recommended extents to which the shoulder strap may be extended or retracted to provide different lengths for the shoulder strap. For example, the indicators may indicate a maximum extension that indicate a recommended maximum extent to which the flexible end portion may extend beyond the first slot. The indicators may indicate the maximum extent to which the flexible end portion of the show strap be retracted into the pack portion. In some implementations, such indicators may be provided by various stitching, materials, coloring, graphics, text or the like.

In some implementations, such indicators may provide a tactile indication. For example, in some implementations, the backpack may be provided with an extension stop on the flexible end portion of the shoulder strap, wherein the extension stop is located between the sheet and the inner compartment. The extension stop may be configured to resist or, in some implementations prevent, movement of the extension stop through the second slot. For example, the extension stop may comprise a thicker or wider portion that is sized such that it cannot pass through the second slot or such that resistance occurs when a person attempts to pull the extension stop through the second slot. Such an extension stop may likewise be provided at a location corresponding to the maximum extent to which the flexible end portion may be retracted into the pack.

In some implementations, the backpack may be adjustable in that the length of the shoulder step and the top location at which the shoulder strap begins are adjustable. By allowing the top location of the shoulder strap to be adjustable, the shoulder step may accommodate different back lengths for different persons wearing the backpack. In some implementations, the backside and the back portion may comprise a third slot below the first slot, wherein the sheet comprises a fourth slot aligned with the third slot and vertically spaced from the second slot.

The flexible end portion of the shoulder strap may be configured to be withdrawn from the first slot and the second slot and may be configured to be passed through the third slot and the fourth slot, setting a new top location at which the shoulder strap begins to accommodate different back lengths. At the same time, the flexible end portion of the shoulder strap may be releasably connected to the frame at one of the plurality of available connection locations to adjust a length of the flexible end portion of the shoulder strap that extends beyond the third slot.

The example backpacks may comprise a hip belt having rear end portions that are repositionable and selectively retainable at different angles relative to one another to accommodate different hip cages of different persons that might wear the backpack. The rear end portions may be positioned and retained such that the hip belt is better positioned relative to the iliac crest of the person's hip cage. As a result, loads carried by the pack portion of the backpack may be more stably and more comfortably distributed from the person's shoulders and spine to the person's hips.

In some implementations, the left and right rear end portions are releasably connectable to one another at different positions to provide the different angles. For example in some implementations, the left and right rear end portions may be releasably connected to one another by a hook and loop mechanism that permits the two end portions to be connected to one another at different angles.

In some implementations, the left and right rear end portions pivot about one or more axes. For example, in some implementations, the left and right rear portions overlap one another and are pivotably connected to one another, where the angle may be retained by retainer, such as a fastener, clamp or the like. In some implementations, the left and right rear end portions are each pivotably coupled to one another by a pair of straps, wherein the length of one of the straps extending between the rear end portions may be adjusted relative to the length of the other of the two straps extending between the rear end portions to maintain the left and right rear end portions at different selected angles.

In some implementations, the juncture at which the left and right rear end portions are directly connected to one another or connected to one another by straps, may be located within a rear sleeve of the backpack. The rear sleeve may cover and protect the juncture and inhibit inadvertent release of the angles at which the end portions are retained. In such implementations, the hip belt may be removable from the sleeve such that the angle of the rear end portion may be set prior to reading insertion of the hip belt through the sleeve.

In some implementations, the sleeve, or passage through which the hip belt extends, may be located or sandwiched between the backside of the pack portion and the frame, such as the sheet of the frame. As result, the hip belt not only distributes weight or load received via the frame, but also draws frame or its sheet towards the back of the person wearing the backpack. In some implementations, the hip belt may be connectable to the frame by a hook and loop fastener. In some implementations, the hip belt may be connectable to the frame at a plurality of different available positions within the sleeve.

In some implementations, the left and right rear end portions may be releasably connected to or pivotably coupled to the frame or a rigid or semi rigid sheet of the frame, wherein the left and right rear end portion do not directly connect to one another. In such implementations, the left and right rear end portions may overlap one another in the pivotably coupled to one another for rotation about a single axis. In some implementations, the left and right rear end portions may be connected to the frame by hook and loop fasteners. In some implementations, the left and right rear end portions may be pivotally connected to the frame (the sheet of the frame) for pivoting about two spaced independent axes. In such implementations, the left and right rear end portions, connected to the frame, may extend between the frame and the backside of the pack portion.

In some implementations, the hip belt comprises a front portion opposite the rear portion and the left and right rear end portions. The front portion may include a front left end portion and a front right end portion which are releasably connected to one another by a buckle or the like. In some implementations, the hip belt may further comprise a left side portion and a right side portion. Each of the left side portion and the right side portion is located rearward of a terminus of the front portion by at least 1.5 inches. Each of the left side portion and the right side portion may include an upper rigid band and a lower rigid band. The upper rigid band and the lower rigid band of the left side portion extend to the rear left end portion. The upper rigid band and the lower rigid band of the right side portion extend to the rear right end portion. Each of the left side portion the right side portion further comprises an iliac crest receiving panel between the upper rigid band and the lower rigid band. The iliac crest receiving panel is more flexible than the upper rigid band and the lower rigid band so as to form a softer region for containing the iliac crest of the hip cage of the person wearing the hip belt. As result, the hip belt may be more reliably and comfortably positioned relative to the iliac crest and hip cage of the person wearing the hip belt and backpack.

In some implementations, a flexible mesh may extend between the upper rigid band and the lower rigid band, providing the iliac crest receiving panel. In such implementations, a support extending between the upper rigid band and the lower rigid band may inhibit curling of the upper rigid band and the lower rigid band. For example, in some implementations, the support may be in the form of a foam panel having a lesser rigidity than the upper rigid band and the lower rigid band but a greater rigidity than the flexible mesh. In some implementations, the foam panel may be in the shape of a triangle, wherein the base extends along the lower rigid band to provide enhanced resistance to undesirable upward curling of the lower rigid band.

In some implementations, the hip belt may be interchangeable with other hip belts to accommodate different persons using the backpack. One hip belt may be removed from the sleeve of the backpack or disconnected from the frame of the backpack and replaced with another hip belt. In some implementations, the backpack may be provided without a hip belt, wherein an appropriately sized hip belt may be later selected and used with the backpack. Likewise, differently sized hip belts may be provided for use with a single backpack, permitting the backpack to be used with different anatomies.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

For purposes of this disclosure, the phrase "configured to" denotes an actual state of configuration that fundamentally ties the stated function/use to the physical characteristics of the feature proceeding the phrase "configured to".

For purposes of this disclosure, the term "releasably" or "removably" with respect to an attachment or coupling of two structures means that the two structures may be repeatedly connected and disconnected to and from one another without material damage to either of the two structures or their functioning.

FIG. 1 is a sectional view illustrating portions of an example backpack 20. Backpack 20 is configured to carry a load while being worn along a person's back. Backpack 20 comprises shoulder straps that have an adjustable length to accommodate different shoulder thicknesses. As result, particular portions of a shoulder strap, such as a narrowed portion or a portion containing a pocket for containing a water bottle or the like, may be appropriately positioned relative to the neck and other anatomy of the person wearing the backpack regardless of the person's particular anatomy. In addition, sternum straps extending from the shoulder straps may be more appropriately positioned, to extend across selected portions of the person's chest, based on the anatomy of the person wearing the backpack.

Backpack 20 comprises pack portion 24, frame 28 and shoulder straps 32, one of which is shown. Pack portion 24 is made of a flexible material, such as a canvas or the like. In some implementations, pack portion 24 may be formed from a flexible material such as a woven textile fabric. In some implementations, the fabric may be coated and/or laminated with at least one water-repellent, water resistant, and/or waterproof material.

Pack portion 24 comprises a rear side 36, a bottom side 38, two lateral sides 40 and a front side 42 which, when backpack 20 is worn, faces the back of the person wearing backpack 20. The sides of pack portion 24 form at least one inner compartment 44 which may accommodate a load to be carried. The inner compartment 44 may have internal subdivisions. Moreover, the pack portion 24 may also have outside pockets. Although illustrated as being generally rectangular, pack portion 24 may have a variety of shapes. Assembly of the panels forming the various sides of pack portion 24 may be formed by sewing, welding, fusing or the like.

In the example illustrated, pack portion 24 comprises a top opening 46 to provide access to the internal compartment 44. In the example illustrated, the inner compartment 44 may be closed by a roll-top type closure or a hem-and-draw-cord type closure. In other implementations other closure rings may be utilized with backpack 20. As should be appreciated, pack portion 24 may have a variety of different configurations, not limited to an open top backpack. For example, in some implementations, pack portion 24 may have a closed top with a zippered opening along at least one of its sides, such as along its front side.

Front side 42 extends opposite to rear side 36. Front side 42 is sandwiched between frame 28 and the back of the person to wear backpack 20. Back side 42 comprises a slot 48 sized to permit at least portions of shoulder straps 32 to pass therethrough.

Frame 28 comprises at least one rigid or semi rigid sheet or panel, wherein the sheet or panel is more rigid than the flexible material forming pack portion 24. Frame 28 maintains the shape of pack portion 24 along the back of the person wearing backpack 20. Frame 28 further assists in transferring and distributing the load carried by backpack 20 to the person wearing backpack 20. Frame 28 may be formed from material such as plastics, composite materials, metals and the like. Frame 28 has an appropriate thickness to exhibit sufficient strength without excessive weight. In some implementations, the structural sheet forming frame 28 may be formed so as to conform to the shape of the back of the person to wear backpack 20, either by thermoforming or shaping a reinforcing stay. In some implementations frame 28 may comprise a layer of foam laminated to the rigid or semi rigid panel. In some implementations, frame 28 may include stays or other structures to reunify selected portions of frame 28. In some implementations, the rigid or semi rigid sheet or panel forming frame 28 may have a varying thickness to provide different portions with different degrees of rigidity or stiffness. For example, in some implementations, the rigid or semi rigid sheet may have a thicker region vertically extending along frame 28 at a lateral midpoint of frame 28. Such thicker portions may form a frame spine which extends generally opposite the spine of the person to wear backpack 20.

Frame 28 may be secured to front side 42 of pack portion 24, with front side 42 extending between frame 28 and the back of the person to wear backpack 20. In some implementations, frame 28 is received within interior 44 and bonded, fastened, welded, stitched or otherwise secured to front side 42. In some implementations, backpack 20 may comprise a pocket or gusset along the interior 44 and adjacent front side 42, wherein frame 28 is removably received within the gusset. In some implementations, frame 28 may be secured to and within the gusset by adhesive bonding, fastening, welding, stitching and the like or may be secured to front side 42 while within the gusset.

Frame 28 comprises slot 50 which extends through frame 28 and is sized such that at least portions of shoulder strap 32 may pass therethrough. Slot 50 is in substantial alignment with slot 48 of front side 42. In some implementations, slots 48 and 50 comprise horizontal slots. In other implementations, slots 48 and 50 may extend at an angle, being angled downwardly towards lateral sides of backpack 20.

Shoulder straps 32 (one of which is shown) serve as a carrying system for backpack 20. Each shoulder strap 32 has a lower end 54 attached to pack portion 24 and a flexible end portion 58 that passes through the aligned slots 48 and 50, wherein the flexible end portion 58 is adjustably connected to frame 28 to adjust a length of the flexible end portion 58 that extends beyond slot 48, outside of pack portion 24. In some implementations, flexible end portion 58 comprises a strap. In some implementations, flexible end portion 58 may additionally comprise flexible padding.

Figure 2:
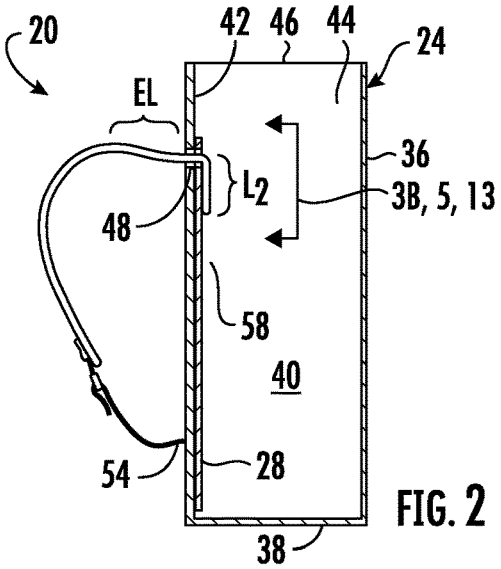
FIG. 2 is a sectional view illustrating portions of the example backpack of FIG. 1 with the shoulder straps having a second extended length.

FIGS. 1 and 2 illustrate shoulder strap 32 adjusted to two different lengths extending beyond slot 48. FIG. 1 illustrates shoulder strap 32 in a shortened state, wherein a first length L1 of flexible end portion 58 has been passed through slots 48 and 50 and resides along frame 28 within pack portion 24. FIG. 2 illustrate shoulder strap 32 in an extended state, wherein a second length L2 a flexible end portion 58 has been passed through slots 48 and 50 and resides along frame 28 within pack portion 24. Length L2 is shorter than length L1, resulting in the flexible end portion 58 having an extended length EL that extends beyond slot 48 for being wrapped over the shoulder of the person wearing backpack 20. In one implementation, the length of the flexible end portion 58 is at least 2.0 inches.

Although FIGS. 1 and 2 illustrate flexible end portion 58 of shoulder straps 32 as having two available states or extents to which flexible end portion 58 projects beyond slot 48, in some implementations, flexible end portion 58 of shoulder strap 32 may have multiple available extended/retracted states. In some implementations, the extent to which flexible end portion 58 projects beyond slot 48, outside of pack portion 24, may be adjusted along a continuum of available extents. In some implementations, the extent to which flexible end portion 58 projects beyond slot 48, outside of pack 24, may be adjusted amongst a plurality of discrete, predefined extents.

Figure 3A:
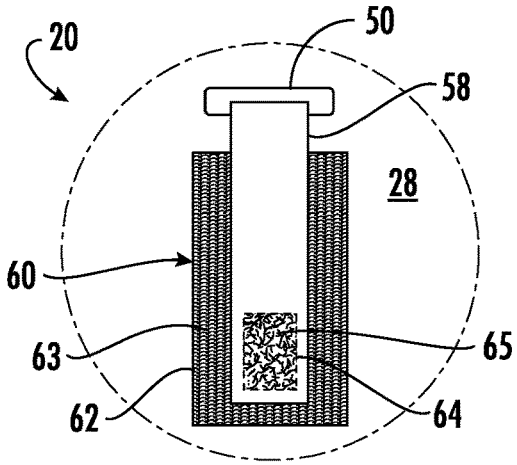
FIG. 3A is an enlarged fragmentary view of a portion of the backpack of FIG. 1 taken along line 3A-3A.
Figure 3B:
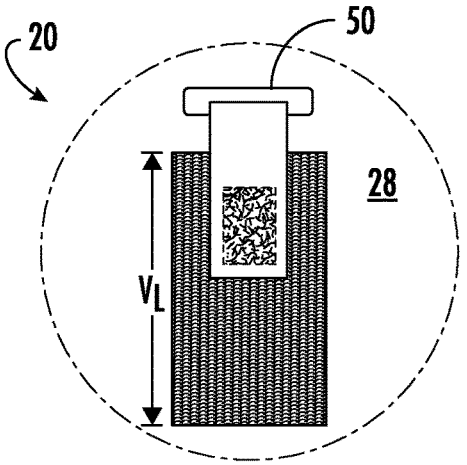
FIG. 3B is an enlarged fragmentary view of the portion of the backpack of FIG. 2 taken along line 3B-3B.

FIGS. 3A and 3B illustrate one example of backpack 20, wherein flexible end portion 58 is adjustably connected to frame 28 by hook and loop system 60 which provides a continuum of different extents that flexible end portion 58 may extend beyond slot 48 (shown in FIGS. 1 and 2). In the implementation shown in FIGS. 3A and 3B, flexible end portion 58 is connected to frame 28 at one of a plurality of available connection locations using the hook and loop (VELCRO™) fastener. In the example illustrated, the hook and loop fastener 60 comprises a first panel or patch 62 attached to frame 28 and supporting a first portion 63 (one of hooks or loops) of the hook and loop fastener 60, and a second panel or patch 64 attached to the flexible end portion 58, facing patch 62, and supporting a second portion 65 (the other of the hooks or loops) of the hook and loop fastener 60. At least one of the panels or patches may have a vertical length to provide multiple connection points. In one implementation, at least one of the panel or patches 62 and 64 has a vertical length VL of at least 3.5 inches, providing a continuum of different available vertical connection locations along the 3.5 inches. In another implementation, the panel or patches 62 and/or 64 of hook and loop material have a vertical length of at least 1 inch.

Figure 4:
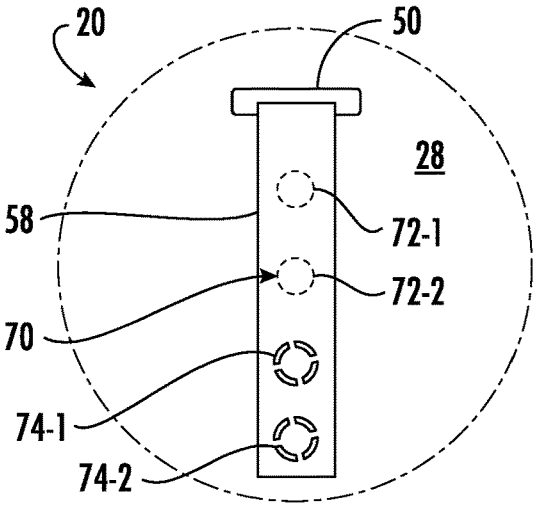
FIG. 4 is an enlarged fragmentary view of a portion of the backpack of FIG. 1 taken along line 4-4.
Figure 5:
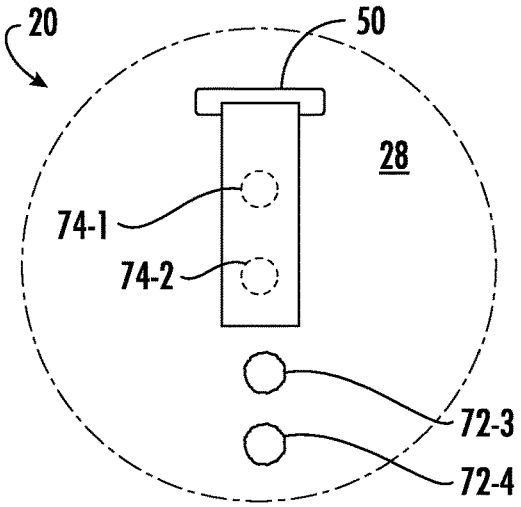
FIG. 5 is an enlarged fragmentary view of the portion of the backpack of FIG. 2 taken along line 5-5.

FIGS. 4 and 5 illustrate one example of backpack 20, wherein, flexible end portion 58 is connected to frame 28 at one of a plurality of available discrete connection locations using a plurality of arranged or spaced snap fasteners 70. In the example illustrated, frame 28 may have attached thereto vertically arranged or spaced snap fastener portions 72-1, 72-2 (both of which are shown in FIG. 4), 72-3 and 72-4 (both of which are shown in FIG. 5) (collectively referred to as fastener portions 72). Flexible end portion 58 may have attached thereto vertically arranged or spaced snap fastener portion 74-1, 74-2 (collectively referred to as snap fastener portions 64). Snap fastener portions 74 may comprise one of a male/stud and a female/socket portion while snap fastener portions 72 comprise the other of the male/stud and the female/socket portion. Snap fastener portions 70 are configured to releasably snap onto any one of snap fastener portions 72.

FIG. 4 illustrates snap fastener portions 74-1 and 74-2 releasably snapped onto snap fastener portions 72-3 and 72-4, respectively, to secure flexible end portion 58 to frame 28 in a first state in which flexible end portion 58 projects or extends beyond slot 48 by first extent. FIG. 5 illustrates snap fastener portion 74-1 and 74-2 releasably snapped onto fastener portions 72-1 and 72-2, respectively, to secure flexible end portion 58 and a second state in which flexible end portion 58 projects or extends beyond slot 48 by a second extent, less than the first extent.

The pair of snap fastener portions 74 which are configured to be concurrently snapped onto a corresponding pair of fastener portions 72 provide a more reliable attachment of flexible end portion 58 at a selected position along frame 28. In other implementations, flexible end portion 58 may comprise a single snap fastener portion 74 for connection to any one of the snap fastener portions 72.

In the example illustrated, the snap fasteners portions 72, which are attached to frame 28 and which outnumber the snap fastener portion 74, provide the plurality of available connection locations for adjusting the length of shoulder straps 32. In other implementations, this arrangement may be reversed. For example, flexible end portion 58 may be provided with a series of vertically arranged or spaced snap fastener portions, which outnumber the snap fastener portions attached to frame 28, for providing the plurality of available connection locations. In such an implementation, frame 28 may be provided with a single snap fastener portion or a plurality of snap fastener portions for more reliable attachment.

Figure 6:
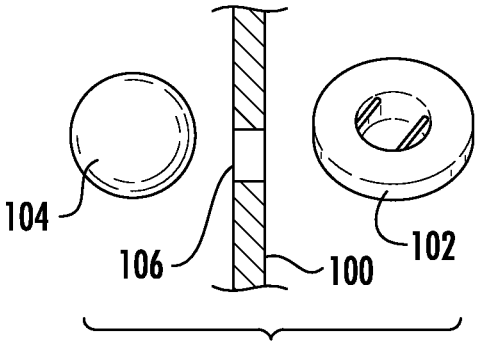
FIG. 6 is an exploded sectional view illustrating a first component of an example snap fastener.
Figure 7:
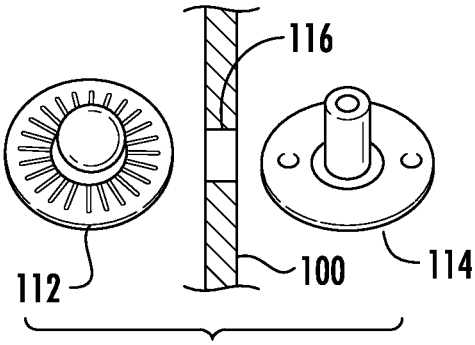
FIG. 7 is an exploded sectional view illustrating a second component of the example snap fasteners FIG. 6, wherein the first component and the second component are releasably snappable to one another.

FIGS. 6 and 7 illustrate different portions of an example snap fastener in the form of an S-spring socket popper. FIG. 6 illustrates panel 100, which may serve as frame 28 or flexible end portion 58. FIG. 6 further illustrates socket 102 and the corresponding socket cap 104. Socket cap 104 attaches to a backside of socket 102, extending through aperture 106 with panel 100 sandwiched between socket 102 and cap 104.

FIG. 7 illustrates panel 110, which may serve as part of frame 28 or part of flexible end portion 58. FIG. 7 further illustrates stud 112 and post 114. Post 114 is attached to a backside of stud 112, extending through aperture 116 with panel 110 sandwiched between stud 112 and post 114. Socket 102 releasably receives and retains stud 112 to secure panels 100 and 110 relative to one another.

Figure 8:
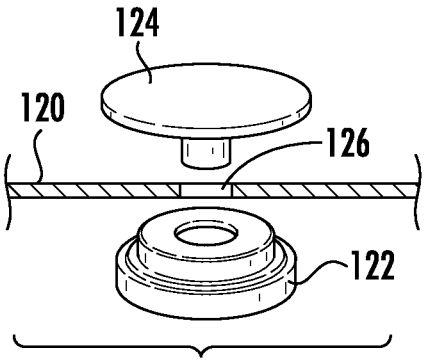
FIG. 8 is an exploded sectional view illustrating a first component of an example snap fastener.
Figure 9:
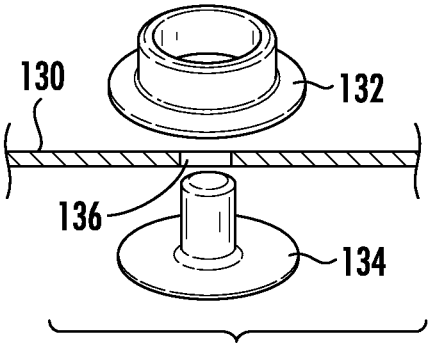
FIG. 9 is an exploded sectional view illustrating a second component of the example snap fastener of FIG. 8.
Figure 10:
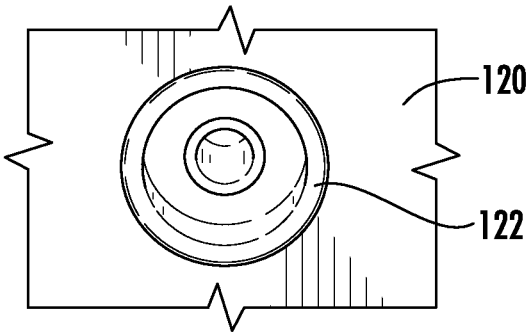
FIG. 10 is a perspective view illustrating the first component of the example snap fastener of FIG. 8.

FIGS. 8 and 9 illustrate different portions of another example snap fastener. FIG. 8 illustrates panel 120, which may serve as frame 28 or flexible end portion 58. FIG. 8 further illustrates socket 122 and the corresponding socket cap 124. Cap 124 attaches to a backside of socket 122, extending through aperture 126 with panel 120 sandwiched between socket 122 and cap 124. FIG. 10 illustrates socket 122 attached to panel 120.

Figure 11:
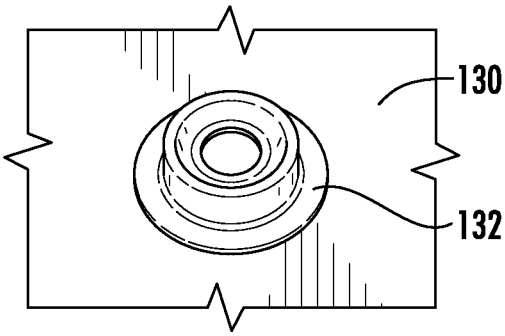
FIG. 11 is a perspective view illustrating the second component of the example snap fastener of FIG. 9, wherein the first component and the second component are releasably snappable to one another.

FIG. 9 illustrates panel 130, which may serve as frame 28 or flexible end portion 58. FIG. 9 further illustrates stud 132 and post 134. Post 134 attaches to a backside of stud 132, extending through aperture 136 with panel 130 sandwiched between stud 132 and post 134. FIG. 11 illustrates stud 132 attached to panel 130. Socket 122 releasably receives and retains stud 132 to secure panels 120 and 130 relative to one another.

Figure 12:
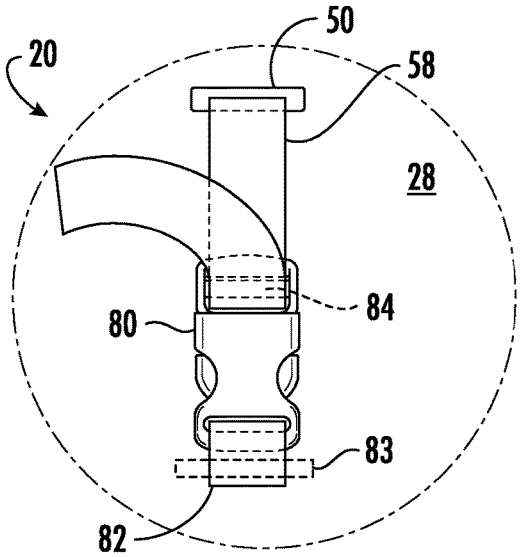
FIG. 12 is an enlarged fragmentary view of a portion of the backpack of FIG. 1 taken along line 12-12.
Figure 13:
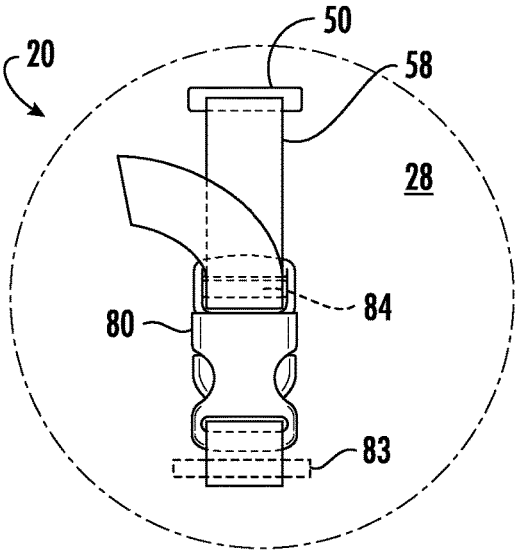
FIG. 13 is an enlarged fragmentary view of the portion of the backpack of FIG. 2 taken along line 13-13.

FIGS. 12 and 13 illustrate one example of backpack 20, wherein flexible end portion 58 is adjustably connected to frame 28 by a buckle 80 which provides a continuum of different extents that flexible end portion 58 may extend beyond slot 48 (shown in FIGS. 1 and 2). Buckle 80 is fastened frame 28 by connection strap 82 and stitching 83. In other implementations, buckle 80 may be secured to frame 28 in other fashions. In the example illustrated, buckle 80 comprises a quick release or side release buckle having an adjustment bar 84, facilitating modification or adjustment of the length of flexible end portion 58. because buckle 80 is a side release buckle, buckle 80 may be releasably detached from frame 28. In other implementations, buckle 80 may comprise other forms of a buckle, such as a ladder lock buckle.

FIG. 12 illustrates flexible end portion 58 pulled through buckle 80 by a first extent and retained such that a first length of flexible end portion 58 projects or extends beyond slot 48. FIG. 13 illustrates flexible end portion 58 pulled through buckle 80 by second lesser extent and retained by adjustment bar 84 such that a second length of flexible end portion 58, greater than the first length, projects or extends beyond slot 48.

Figure 14:
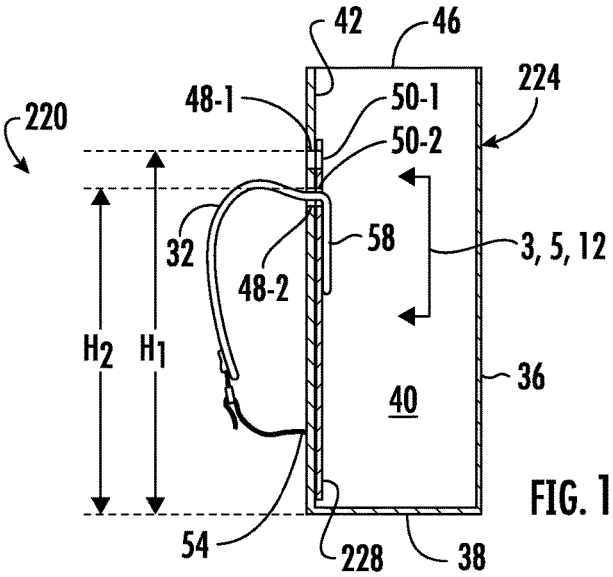
FIG. 14 is a sectional view illustrating portions of an example backpack with shoulder straps having a first extended length.
Figure 15:
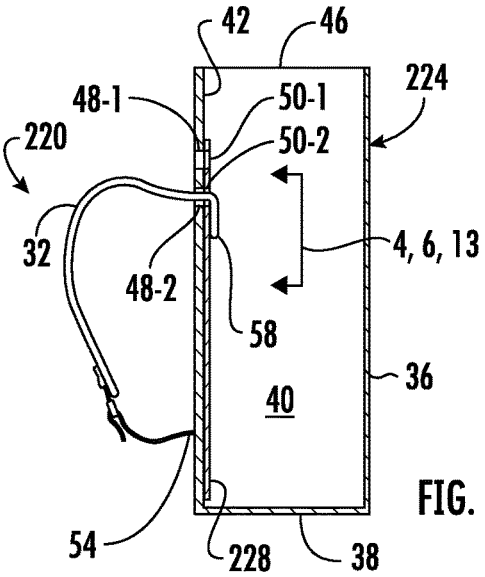
FIG. 15 is a sectional view illustrating portions of the example backpack of FIG. 14 with the shoulder straps having a second extended length.

FIGS. 14 and 15 are sectional views illustrating portions of an example backpack 220. FIGS. 14 and 15 illustrate an example of how the backpack of FIGS. 1 and 2 may be modified to additionally provide height adjustment for the shoulder straps 32. Backpack 220 is similar to backpack 20 described above except that backpack 220 comprises a pack portion 224 comprising slots 48-1, 48-2 (collectively referred to as slots 48) and that backpack 220 comprises frame 228 comprising slots 50-1, 50-2 (collectively referred to as slots 50). Other than the additional slots, pack portion 224 and frame 228 are similar to pack portion 24 and frame 28, respectively, described above.

Slots 48-1 and 50-1 are aligned with one another to facilitate the passing of flexible end portion 58 of shoulder strap 32 therethrough. Slots 48-2 and 50-2 are aligned with one another vertically below slots 48-1 and 50-1. Slots 48-2 and 50-2 are sized and located to facilitate passing of flexible end portion 58 of shoulder strap 32 therethrough. The aligned slots 48-1, 50-1 and aligned slots 48-2, 50-2 facilitate complete withdrawal of one portion 58 of shoulder straps 32 from one of the pair of aligned slots and re-insertion of the flexible end portion 58 through the other of the pair of aligned slots. As a result, shoulder strap 32 may be adjusted so as to extend at either height H1 from the bottom of pack portion 24 when extending through slots 48-1, 50-1 or height H2 from the bottom pack portion 24 when extending through slots 48-2, 50-2. Such height adjustment allows backpack 220 to accommodate persons with different back lengths.

As shown by FIGS. 14 and 15, as with backpack 20, backpack 220 also provides length adjustment of shoulder straps 32 by adjustably connecting flexible end portion 58 of shoulder strap 32 to the frame 28 to adjust a length of the flexible end portion of the shoulder strap 32 that extends beyond the receiving slot, slot 48-1 or slot 48-2. At a selected length, flexible end portion 58 may be secured to frame 28 in any of the fashions described above with respect to FIGS. 3-13. In other implementations, flexible end portion 58 may be secured to frame 28 at a selected connection location by other fasteners or securement mechanisms.

FIGS. 16-19 illustrate portions of an example backpack 320.

FIGS. 16-19 illustrate an example of how a backpack may be adjustable to accommodate different hip cages or different heights for the iliac crest of the person wearing the backpack. FIGS. 16-19 illustrate example of how a hip belt may be provided with rear end portions that are repositionable and selectively retainable at different angles relative to one another to accommodate different hip cages of different persons that might wear the backpack. The rear end portions may be positioned and retained such that the hip belt is better positioned relative to the iliac crest of the person's hip cage. As a result, loads carried by the pack portion of the backpack may be more stably and more comfortably distributed from the person's shoulders and spine to the person's hips. Backpack 320 comprises pack portion 324, frame 328 and hip belt 370.

Pack portion 324 is similar to pack 24 described above except that pack portion 324 does not necessarily include slot 48. Frame 328 is similar to frame 28 described above except that frame 328 does not necessarily include slot 50. Moreover, in some implementations, frame 328 may be attached to pack portion 324 outside of pack portion 324, along an outer side of front side 42.

Hip belt 370 comprise a belt configured to wrap or extend about the waist region of the person wearing backpack 320. Hip belt 370 comprises a front portion 371 and a rear portion 372. Front portion 371 may comprise a buckle or other mechanism 374 configured to releasably connect left and right front-end portions of hip belt 370 at a front region of the waist of the person wearing hip belt 370 and backpack 320.

Rear portion 372 extends at a rear of belt 370 and is configured to extend along the back of a person wearing backpack 320. Rear portion 372 is configured to be coupled to frame 328. Rear portion 372 comprises a rear right end portion 376-R and a rear left end portion 376-L (collectively referred to as end portions 376). End portions 376 are repositionable and selectively retainable at different angles relative to one another.

Figure 17:
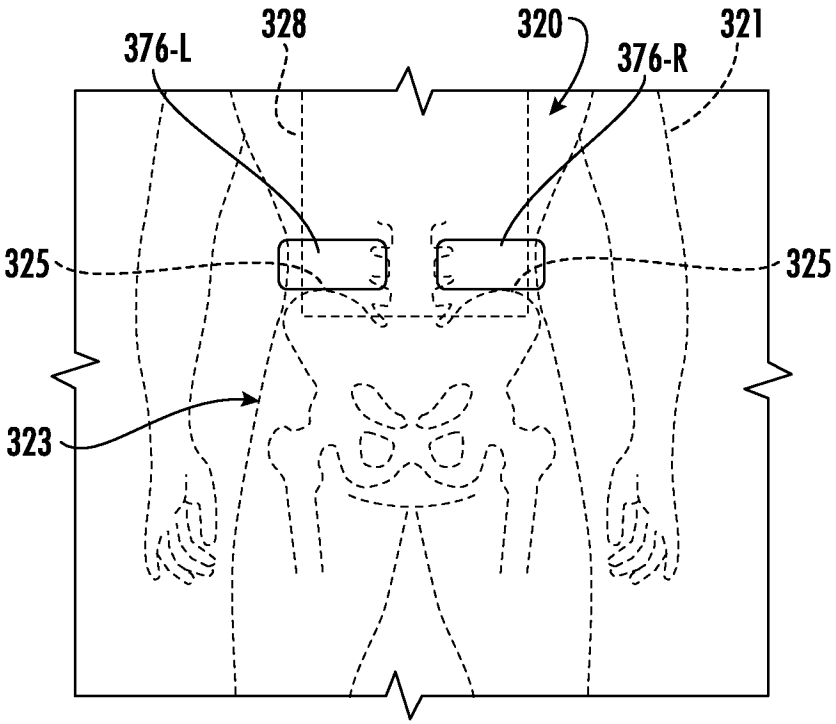
FIG. 17 is a front view illustrating the example hip belt of FIG. 16 being worn by a first example person.
Figure 16:
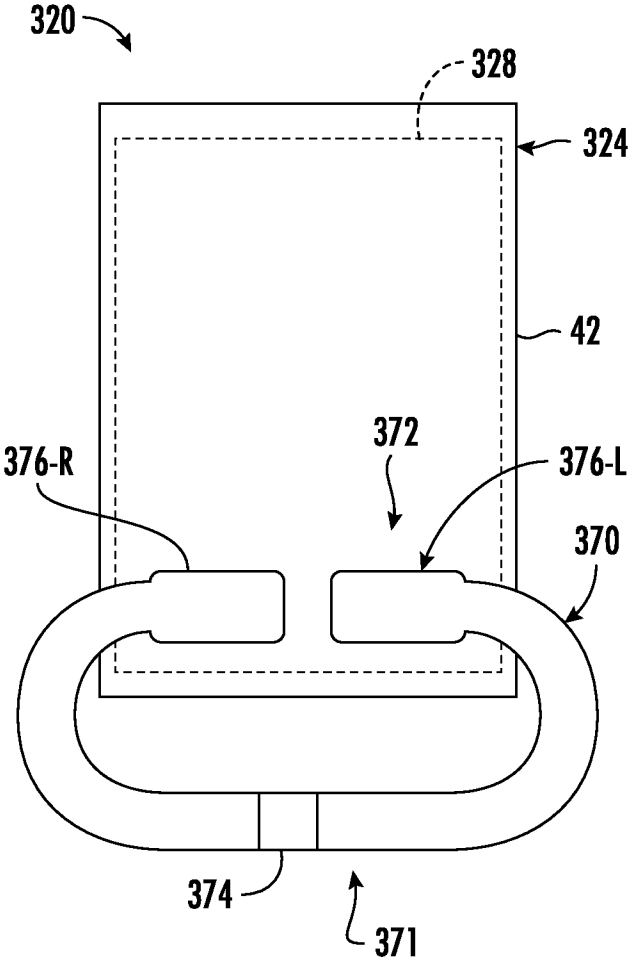
FIG. 16 is a front view schematically illustrating portions of an example backpack including an example hip belt with rear end portions at a first angle.

FIGS. 16 and 17 illustrate end portions 376 in a first angular orientation, a substantially horizontal orientation. FIG. 17 illustrates backpack 320 being worn along the back of a person 321. FIG. 17 further illustrates hip cage 323 and iliac crests 325 of the hip cage 323. As shown by FIG. 17, for the particular person 321 and his or her hip cage 323, end portions 376 are retained at an angle so as to extend across or just above the top of the iliac crest 325 on either side of the person 321. As result, the load within pack portion 324 and distributed to frame 328, is further distributed to iliac crests 325 across the person's hip cage 323.

Figure 19:
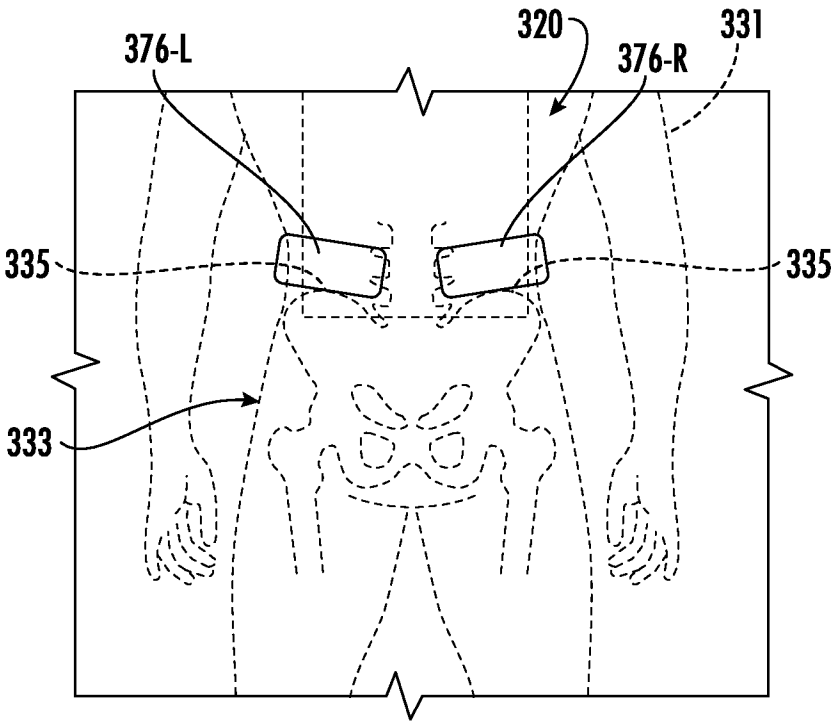
FIG. 19 is a front view illustrating the example hip belt of FIG. 18 being worn by a second example person.
Figure 18:
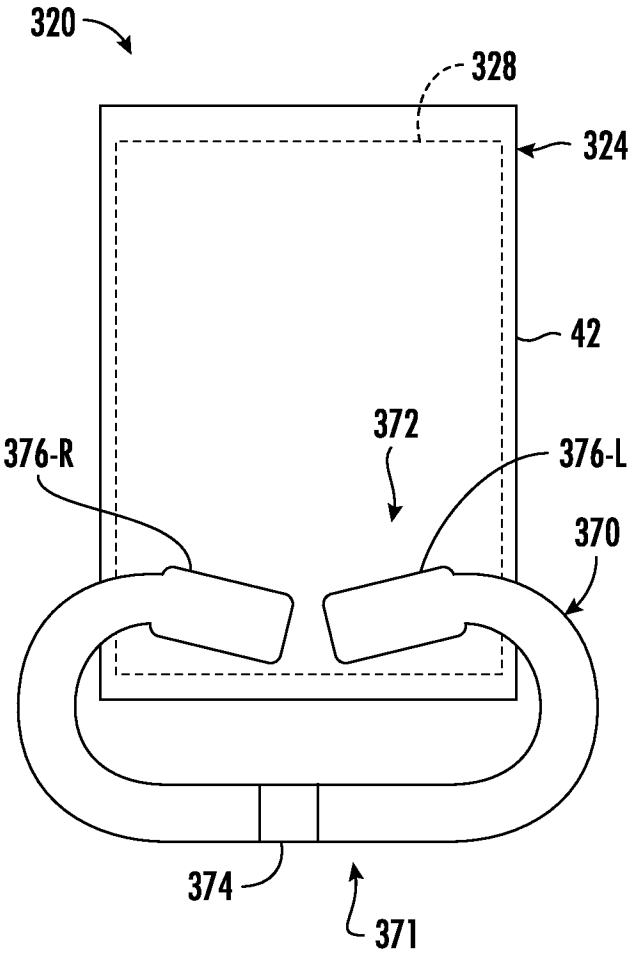
FIG. 18 is a front view schematically illustrating portions of the example backpack of FIG. 16 with rear end portions of the example hip belt at a second angle.

FIGS. 18 and 19 illustrate end portion 376 in a second angular orientation in which each of end portions 376 is angled in an upward and outward direction. FIG. 19 illustrates backpack 320 being worn along the back of a person 331 having a hip cage 333 with iliac crest 335. As shown by FIG. 19, person 331 has wider or higher iliac crests 335. In portion 336 are positioned and retained at angles so as to extend across or just above the top of the iliac crests 335 on both sides of person 331. As a result, load the pack portion 324 and distributed to frame 328, further distributed to iliac crest 335 across the person's hip cage 333. Because end portions 376 are repositionable and selectively retainable at different angles relative to one another, hip belt 370 may accommodate different persons having different hip cages with differently located are sized iliac crests, to better distribute load to the person's hip.

Figure 20:
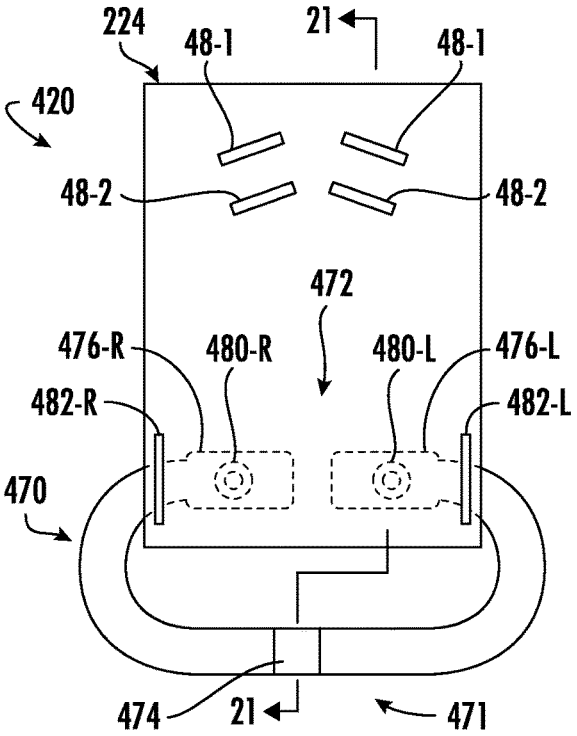
FIG. 20 is a front view illustrating portions of an example backpack.
Figure 21:
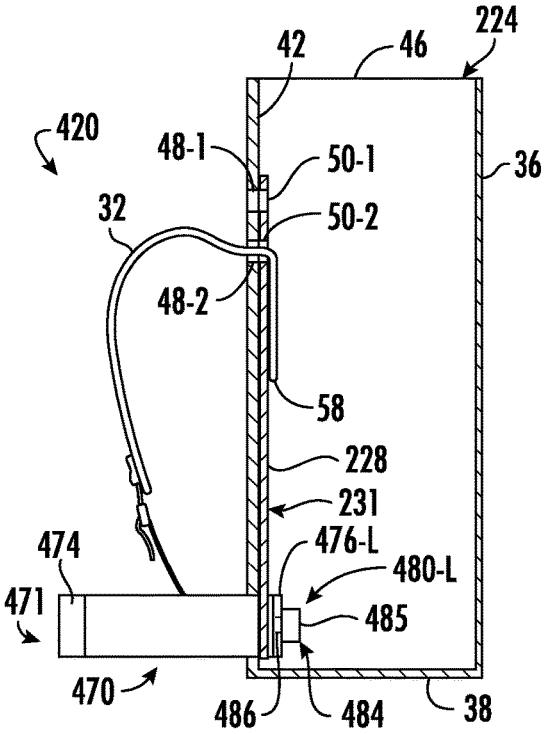
FIG. 21 is a sectional view of the example backpack of FIG. 20 taken along line 21-21.

FIGS. 20-32 illustrate different examples of angle retainers for positioning and retaining rear end portions of a hip belt at different angles relative to one another. FIGS. 20 and 21 illustrate portions of an example backpack 420. FIG. 20 is a front view of backpack 420 without shoulder straps 32. FIG. 21 is a sectional view of backpack 420 with shoulder straps 32 taken along line 21-21 of FIG. 20. Backpack 420 is similar to backpack 220 described above except that backpack 420 comprises hip belt 470 and angle retainers 480. Those remaining components of backpack 420 which correspond to components of backpack 220 are numbered similarly.

Hip belt 470 is similar to hip belt 370 in that hip belt 470 comprises a belt configured to wrap or extend about the waist region of the person wearing backpack 420. Hip belt 470 comprises a front portion 471 and a rear portion 472. Front portion 471 may comprise a buckle or other mechanism 474 configured to releasably connect left and right front end portions of hip belt 470 at a front region of the waist of the person wearing hip belt 470 and backpack 420.

Rear portion 472 extends at a rear of belt 470 and is configured to extend along the back of a person wearing backpack 420. Rear portion 472 is configured to be coupled to frame 228. Rear portion 472 comprises a rear right end portion 476-R and a rear left end portion 476-L (collectively referred to as end portions 476).

Rear end portions 476-R, 476-L pass through slots 482-R, 482-L in front side 42 of pack portion 224. In the example illustrated, rear end portions 476-R and 476-L further pass around the outer side edges of frame 228 so as to extend along a rear face 231 (shown in FIG. 21) of frame 228. In some implementations, rear end portions 476 may alternatively extend through slots in frame 228 corresponding to slots 482 and that are sufficiently long/tall to accommodate the different angles for rear end portions 476.

Angle retainers 480-R, 480-L (collectively referred to as angle retainers 480) retain end portions 476-R, 476-L, respectively, at different angles relative to one another to accommodate different hip cages and iliac crests as described above with respect to FIGS. 16-19. As shown by FIG. 21, each of retainers 480 may comprise a threaded bolt 484 having a head 485 and a threaded shaft 486. Head 485 is held against a backside of the associated one of end portions 476 while threaded shaft 486 extends from head 485 and passes through the associated one of the end portions 476 and into threaded engagement with a threaded bore provided in frame 228 or adjacent frame 228. In some implementations, frame 228 may comprise an embedded threaded nut. In some implementations, a threaded nut may be provided between frame 228 and front side 42, wherein threaded shaft 486 passes through frame 228. Once the particular end portion 476 is at a selected angle, head 485 may be turned and tightened against the associated one of rear end portions 476 to frictionally retain the associated one of the rear end portions 476 at the selected angle. Loosening of bolt 484 will once again permit the angle of the particular end portion 476 to be adjusted. In such an implementation, bolt 484 couples hip belt 470 to frame 228.

Figure 22:
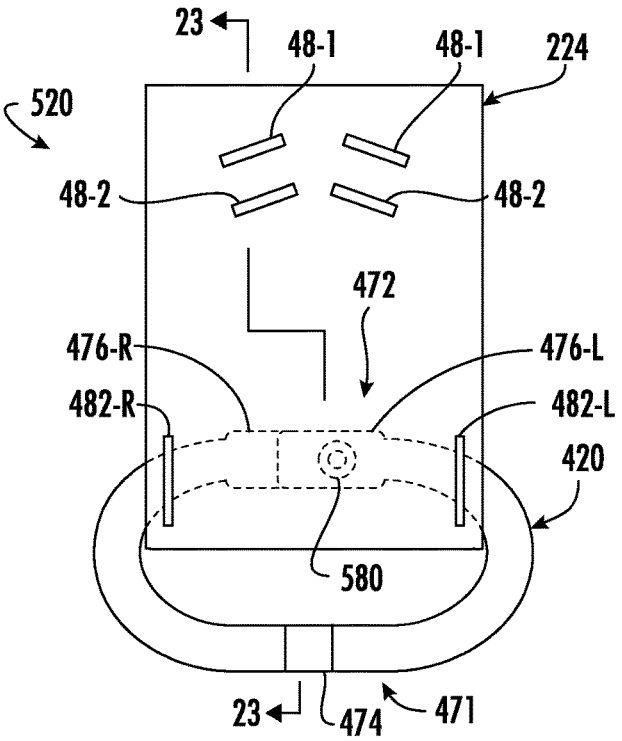
FIG. 22 is a front view illustrating portions of an example backpack having an example hip belt with rear end portions at a first angle.
Figure 23:
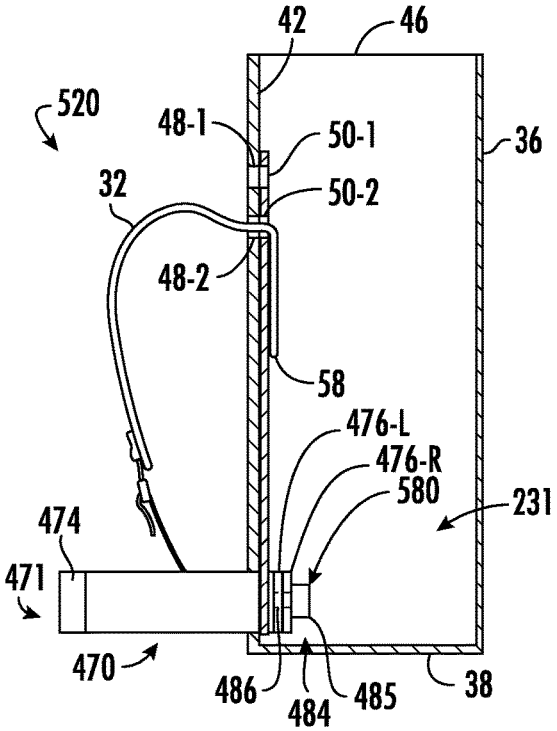
FIG. 23 is a sectional view of the example backpack of FIG. 22 taken along line 23-23.

FIGS. 22 and 23 illustrate portions of an example backpack 520. FIGS. 22 and 23 illustrate an example of how a single angle retainer may be used to retain both end portions 476 at selected angles relative to one another. FIG. 22 is a front view of backpack 520 without shoulder straps 32. FIG. 23 is a sectional view of backpack 520 with shoulder straps 32 taken along line 23-23 of FIG. 22. Backpack 520 is similar to backpack 420 described above except that backpack 520 comprises angle retainer 580 in place of angle retainers 480. Those remaining components of backpack 520 which correspond to components of backpack 420 are numbered similarly.

End portions 476 of backpack 520 overlap one another on side 231 of frame 228. This overlap facilitates the use of a single angle retainer 580 for retaining both end portions 476 at a selected angle. As shown by FIG. 23, angle retainer 580 is similar to angle retainer 480-L or 480-R except that shaft 486 of the bolt 484 serving as angle retainer 580 passes through both of end portions 476 prior to threadably engaging a threaded bore provided on frame 228 or provided between frame 228 and front side 42 of pack portion 224 (as described above with respect to backpack 420). Once both of the end portions 476 are at selected angles, head 485 may be turned and tightened against rear end portion 476-R to frictionally retain both of end portions 476 at the selected angles. Loosening of bolt 484 will once again permit the angles of the end portions 476 to be adjusted. In such an implementation, bolt 484 couples both end portions 476 of hip belt 470 to frame 228. In some implementations, the mutually facing surfaces of end portions 476 may be provided with teeth that engage one another to assist in retaining the selected angles once the bolt 484 is tightened.

Figure 24:
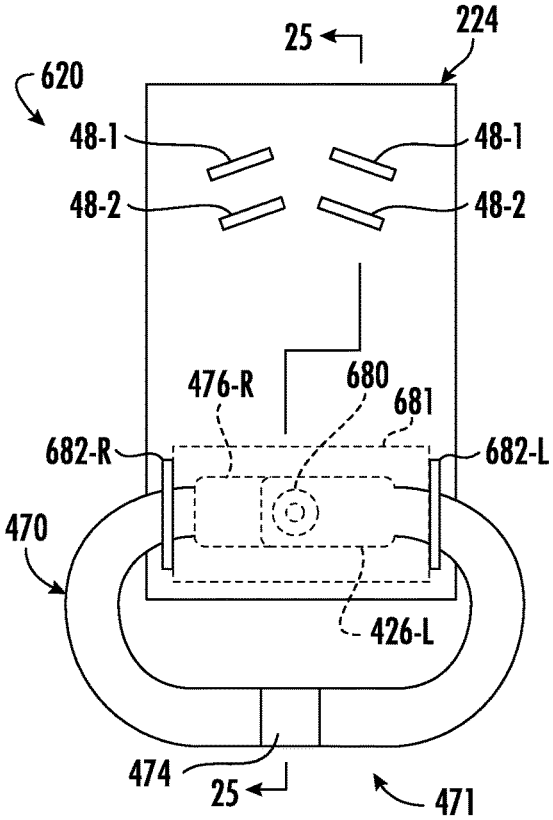
FIG. 24 is a front view illustrating portions of an example backpack having an example hip belt with rear end portions at a first angle.
Figure 25:
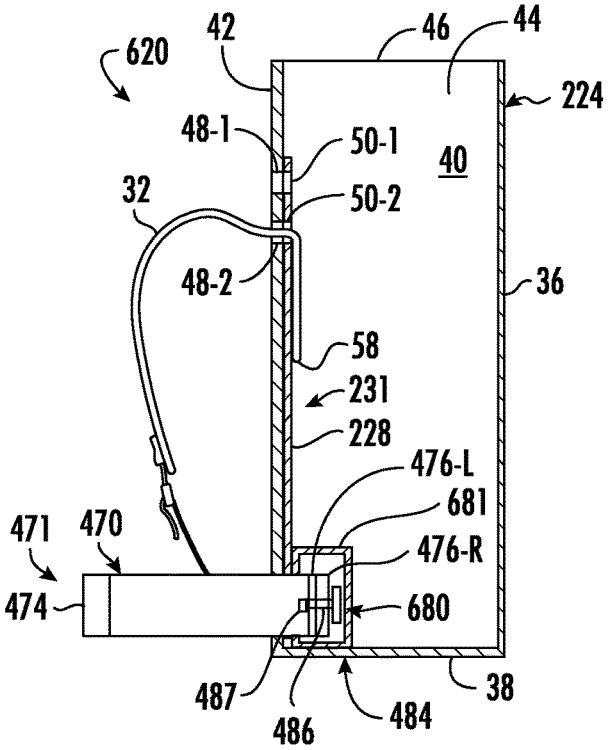
FIG. 25 is a sectional view of the example backpack of FIG. 24 taken along line 25-25.
Figure 26:
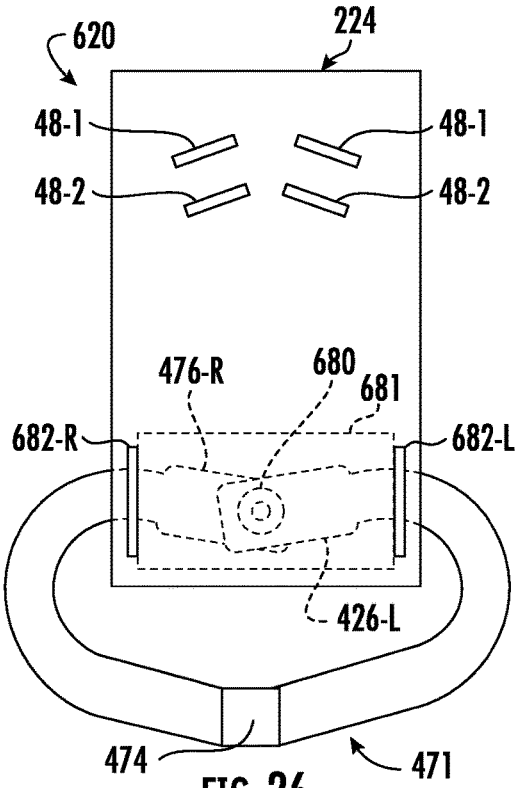
FIG. 26 is a front view of the example backpack of FIG. 24 having the example hip belt with the rear end portions at a second angle.

FIGS. 24-26 illustrate portions of an example backpack 620 FIGS. 24 and 26 are rear views of backpack without shoulder straps 32. FIG. 25 is a sectional view of backpack 620, with shoulder straps 32, and taken along line 25-25. Backpack 620 is similar to backpack 520 except that backpack 620 comprises sleeve 681 and comprises angle retainer 680 instead of angle retainer 580. Those remaining components of backpack 620 which correspond to components of backpack 520 are numbered similarly.

Sleeve 681 is located on side 231 of frame 228, being located or sandwiched between frame 228 and the interior 44 of pack portion 224. Sleeve 681 comprises mouths or slots 682-R and 682-L (collectively referred to as slots 682) at opposite lateral sides of sleeve 681. Slots 682 have vertical lengths or heights sufficient to accommodate the different angular positions of end portions 476. Sleeve 681 removably receives end portions 476 of hip belt 470, facilitating separation of hip belt 470 from pack portion 224. Sleeve 681 further covers and protects end portions 476 and angle retainer 680. Sleeve 681 may reduce the likelihood of angle retainer 680 catching upon an external object or being inadvertently loosened to allow inadvertent changes to the angles of end portions 476.

Sleeve 681 is connected to frame 228. In some implementations, sleeve 681 comprises one or more panels forming an uninterrupted tube, wherein the tube is coupled to frame 228, directly or indirectly. For example, in some implementations, sleeve 681 may be stitched, welded, fastened or otherwise attached to frame 228. In some implementations, sleeve 681 may be formed by joining opposite edges of a panel directly to frame 228, wherein frame 228 forms one side of the sleeve interior.

Retainer 680 is similar to retainer 580 described above except that shaft 486 of bolt 484 does not threadably engage frame 228, but threadably engages a nut 487 within sleeve 681. Once both of the end portions 476 are at selected angles, head 485 may be turned relative to nut 487 and tightened to frictionally retain both of end portions 476 at the selected angles. FIG. 24 illustrates end portions 476 at first angles relative to one another and FIG. 26 illustrates end portions 476 at second angles relative to one another. As discussed above, the ability to adjust the angles of end portions 476 enables hip belt 470 to accommodate different hip cages and different iliac crests of different persons wearing backpack 620.

Loosening of bolt 484 will once again permit the angles of the end portions 476 to be adjusted. Bolt 484 may be separated from nut 47 and withdrawn from at least rear end portion 476-L to permit end portions 476 to be separated from one another and to be withdrawn from sleeve 681 for detachment from pack portion 224.

In some implementations, rear end portions 476 are freely vertically movable within sleeve 681, wherein load within pack portion 224 are transmitted to hip belt 470 through the contact in engagement between the top of sleeve 681 and the top of end portions 476 of hip belt 470. In some implementations, rear end portions 476 may be releasably attached to sleeve 681 and/or to frame 228 while within sleeve 681 such that loads may be transmitted from frame 228 to hip belt 470. For example, in some implementations, rear end portions 476 may be releasably attached to the interior of sleeve 681 or side 231 of frame 228 by hook and loop fastener. One or both of end portions 476 may be provided with one component of a hook and loop fastener (hooks or loops) while sleeve 681 or side 231 of frame 228 is provided with the other component of the hook and loop fastener (loops or hooks). In some implementations, sleeve 681 may comprise an opening through which end portions 476 are directly connected to frame 228. In yet other implementations, end portions 476 may be releasably attached to sleeve 681 and/or frame 228 by snap fasteners (described above) or other attachment mechanisms.

Figure 27:
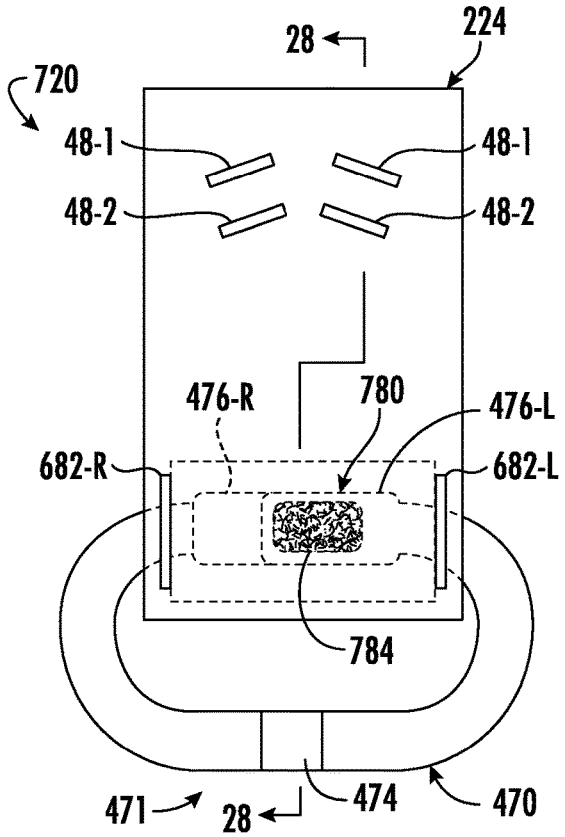
FIG. 27 is a front view illustrating portions of an example backpack having an example hip belt with rear end portions at a first angle.
Figure 28:
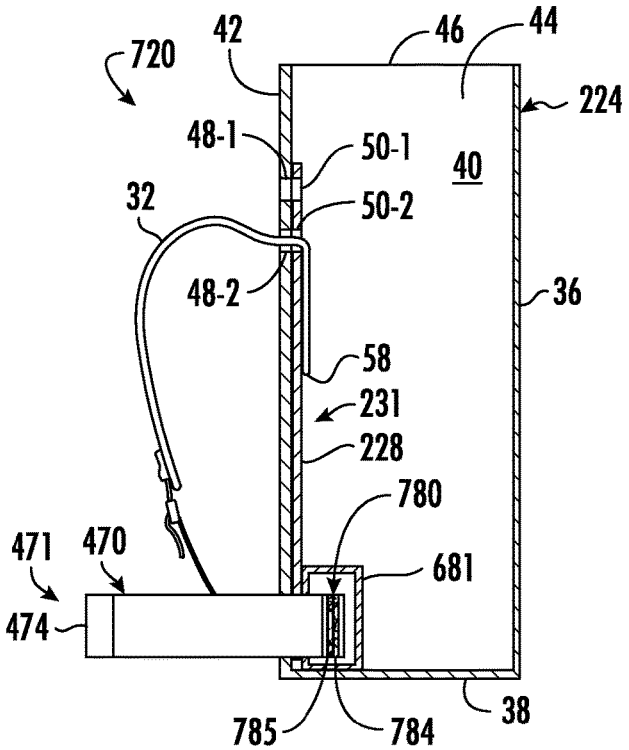
FIG. 28 is a sectional view of the example backpack of FIG. 24 taken along line 28-28.
Figure 29:
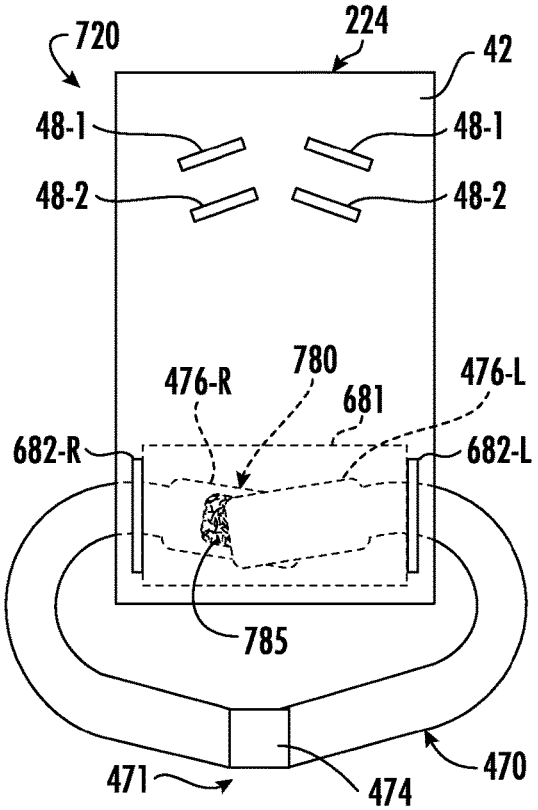
FIG. 29 is a front view of the example backpack of FIG. 27 having the example hip belt with the rear end portions at a second angle.

FIGS. 27-29 illustrate portions of an example backpack 720 FIGS. 27 and 29 are rear views of backpack without shoulder straps 32. FIG. 28 is a sectional view of backpack 620, with shoulder straps 32, and taken along line 28-28 of FIG. 27. Backpack 620 is similar to backpack 620 except that backpack 720 comprises angle retainer 780 in place of angle retainer 680. Those remaining components of backpack 720 which correspond to components of backpack 620 are numbered similarly.

Angle retainer 780 facilitates relative angular adjustment of end portions 476 and retains such end portions 476 at selected relative angles. In the example illustrated, angle retainer 780 comprises hook and loop fastener patches on the mutually facing surfaces of the overlapping end portions 476. End portion 476-L has one component 784 of a hook and loop fastener (hooks or loops) while end portion 476-R has the other component 785 of the hook and loop fastener (loops or hooks).

Hook and loop components 784, 785 may be pulled apart and separated to permit end portions 476 to be oriented at selected angles relative to one another. Once both of the end portions 476 are at selected angles, components 784 and 786 of the hook and loop fastener may be brought into contact and engagement with one another to retain end portions 476 at the selected angles. FIG. 27 illustrates end portions 476 at first selected angles. FIG. 29 illustrates end portions 476 at second angles relative to one another. As discussed above, the ability to adjust the angles and portions 476 enables hip belt 470 to accommodate different hip cages and different iliac crests of different persons wearing backpack 720.

Separation of hook and loop fastener components 784, 785 will once again permit the angles of the end portions 476 to be adjusted. Separation of component 784, 785 may further permit end portions 476 to be separated from one another and to be withdrawn from sleeve 681 for detachment from pack portion 224.

As with backpack 620, in some implementations, rear end portions 476 are freely vertically movable within sleeve 681, wherein the load within pack portion 224 are transmitted to hip belt 470 through the contact and engagement between the top of sleeve 681 and the top of end portions 476 of hip belt 470. In some implementations, rear end portions 476 may be releasably attached to sleeve 681 and/or to frame 228 while within sleeve 681 such that loads may be transmitted from frame 228 to hip belt 470. For example, in some implementations, rear end portions 476 may be releasably attached to the interior of sleeve 681 or side 231 of frame 228 by hook and loop fastener. One or both of end portions 476 may be provided with one component of a hook and loop fastener (hooks or loops) while sleeve 681 or side 229 of frame 228 is provided with the other component of the hook and loop fastener (loops or hooks). In some implementations, sleeve 681 may comprise an opening through which end portions 476 are directly connected to frame 228. In yet other implementations, end portions 476 may be releasably attached to sleeve 681 and/or frame 228 by snap fasteners (described above) or other attachment mechanisms.

Figure 30:
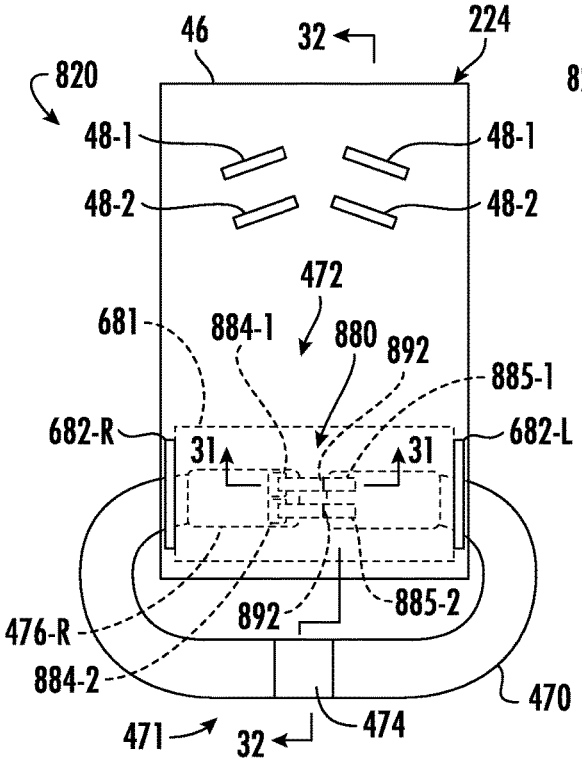
FIG. 30 is a front view of an example backpack having an example hip belt with rear end portions at a first angle.
Figure 31:
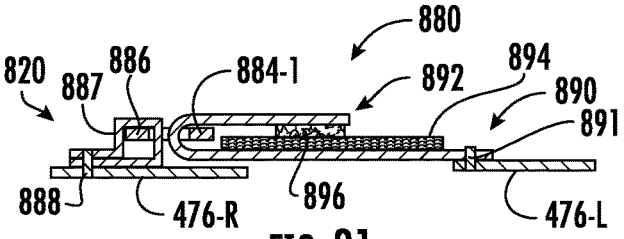
FIG. 31 is a sectional view of the example backpack of FIG. 30 taken along line 31-31.
Figure 32:
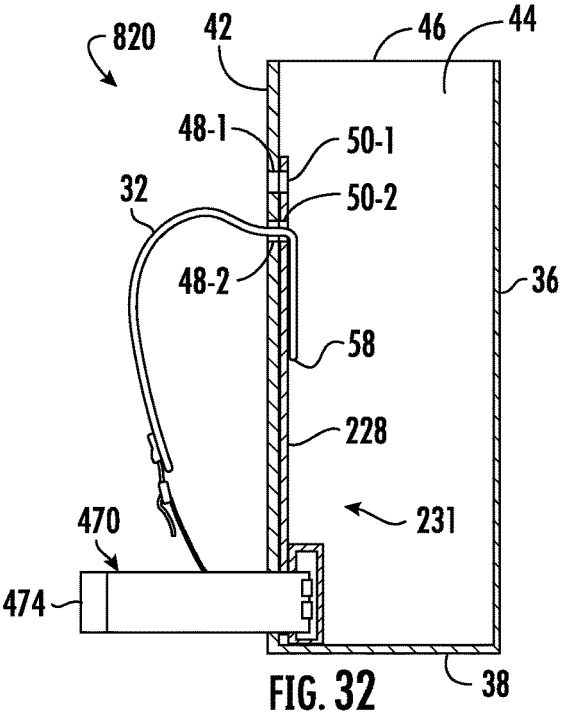
FIG. 32 is a sectional view of the example backpack of FIG. 30 taken along line 32-32.
Figure 33:
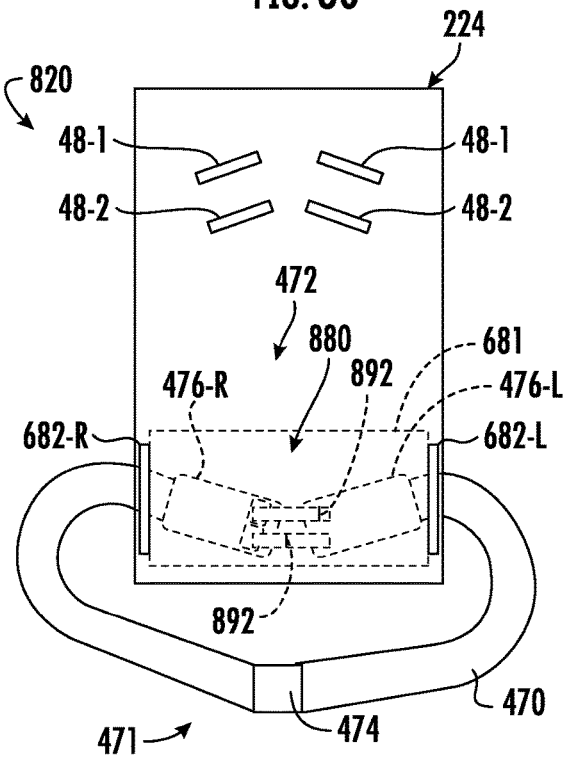
FIG. 33 is a front view of the example backpack having the example hip belt with the rear end portions at a second angle.

FIGS. 30-33 illustrate portions of an example backpack 820. FIGS. 30 and 33 are front views of backpack 820 without shoulder straps 32. FIG. 31 is a sectional view of backpack 820 taken along line 31-31 of FIG. 30. FIG. 32 is a sectional view of backpack 820, with shoulder straps 32, and taken along line 32-32 of FIG. 30. Backpack 820 is similar to backpack 720 except that backpack 820 comprises angle retainer 880 in place of angle retainer 780. Those remaining components of backpack 820 which correspond to components of backpack 720 are numbered similarly.

Angle retainer 880 facilitates relative angular adjustment of end portions 476 and retains such end portions 476 at selected relative angles. In the example illustrated, angle retainer 880 comprises turn bars 884-1, 884-2 (collectively referred to as turn bars 884) and connector straps 885-1 and 885-2 (collectively referred to as straps 885). Turn bars 884 comprise structures secured to or formed as part of rear end portion 476-R. Turn bars 884 provide structures about which free ends of straps 885 may turn and wrap to releasably connect rear end portions 476-R to rear end portions 476-L. As shown by FIG. 31, in the example illustrated, turn bars 884 each comprise a portion of ring 886 which is secured to rear end portions 476R. In the example illustrated, the ring 886, providing turn bar 884-1, is secured to rear end portions 476-R by a loop 887 which is attached to rear end portion 476-R by stitching 888. As will be described hereafter, turn bar 884-1 may be provided by other structures. Turn bar 884-2 may be similar to turn bar 884-1.

Straps 885 extend from rear end portion 476-L and wrap about turn bar 884-1 before being releasably connected to themselves. As shown by FIG. 31, each of straps 885 has a fixed end portion 890 attached to rear end portion 476-L by stitching 891 and an opposite free end portion 892. Free end portion 892 comprises patch 894 of a first component (hooks or loops) of a hook and loop fastener and a patch 896 of a second component (loops or hooks) of the hook and loop fastener. At least one of patches 894, 896 has a length along its respective strap 885 to facilitate releasable attachment of free end 892 to itself in a plurality of available locations. In such an implementation, the free end 892 of strap 885 may be fed through and wrapped about the turn bar 884 to reverse in direction and to attach to itself, after passing around turn bar 884, using the two patches 894, 896.

As shown by FIGS. 30 and 33, by varying the extent to which the two straps 885 turnabout the turn bars 884 and the locations of the self attachments, the lengths of the two straps 885 between the end portions 476 may be adjusted and varied to retain the end portions 476 and any one of multiple relative angles. FIG. 30 illustrates both of straps 885 having equal extents or lengths wrapped about turn bars 884 such that end portions 476 are substantially level relative to one another. FIG. 33 illustrates an example where a greater extent or length of strap 885-1 is wrapped or turned about turn bar 884-1 than the extent to which strap 885-2 is wrapped about its turn bar 884-1. As a result, rear end portions 476 are coaxial and are retained at selected angles relative to one another to accommodate steeper iliac crests.

Figure 34:
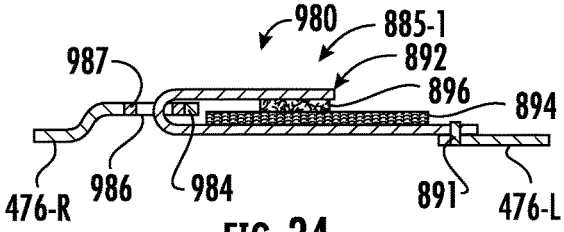
FIG. 34 is a sectional view of an example backpack taken along line 31-31 of FIG. 30.

FIG. 34 illustrates portions of an example angle retainer 980 that may be utilized in place of angle retainer 880 in backpack 820. Angle retainer 980 is similar to angle retainer 880 in all respects except that angle retainer 980 comprises a turn bar 984 for each of the two straps 885. Similar to FIG. 31, FIG. 34 is a sectional view taken through one of the two turn bars 984 and one of the two straps 885. As shown by FIG. 34, turn bar 984 comprises an opening 986 extending through rear end portion 476-R, wherein the free end 892 of strap 885-1 passes through the opening 986 and is reversed in direction for attachment to itself using patches 894 and 896. Each of the two straps 885 may wrap about its respective turn bar 984 by different extents to retain end portions 476 at selected angles relative to one another.

In some implementations, opening 986 may be lined with a coating, grommet or other protective structure 987 have a greater degree of durability, stiffness or strength as compared to the material forming rear end portions 476-R. In some implementations, opening 986 may omit structure 987.

Figure 35:
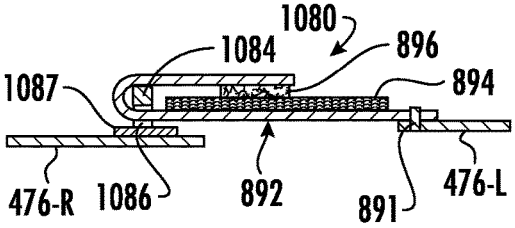
FIG. 35 is a sectional view of an example backpack taken along line 31-31 of FIG. 30.

FIG. 35 illustrates portions of an example angle retainer 1080 that may be utilized in place of angle retainer 880 in backpack 820. Angle retainer 1080 is similar to angle retainer 880 in all respects except that angle retainer 1080 comprises a turn bar 1084 for each of the two straps 885. Similar to FIG. 31, FIG. 35 is a sectional view taken through one of the two turn bars 1084 and one of the two straps 885. As shown by FIG. 35, turn bar 1084 is in the form of a rung 1087 that is attached to rear end portions 476-R and that forms an opening 1086 that extends parallel to the surface of rear end portion 476-R. Rung 1087 may be attached to rear end by stitching, welding, adhesives and the like. Free end 892 of strap 885-1 passes through the opening 1086 and is reversed in direction to wrap about turn bar 1084 for attachment to itself using patches 894 and 896. Each of the two straps 885 may wrap about its respective turn bar 1084 by different extents to retain end portions 476 at selected angles relative to one another.

Although each of the straps 885 of angle retainers 880, 980 and 1080 are illustrated as being attached to themselves by patches 894 and 896 of a hook and loop fastener, after wrapping about the respective turn bars 884, 984 and 1084, in other implementations, the free end portion 892 of each of straps 885 may attach to itself using other mechanisms. For example, in other implementations, free end portion 892 of each of straps 885 may attached to itself using snap fasteners. For example, patch 894 may be replaced with a plurality of first components of a snap fastener (socket or stud) (see FIGS. 6-11) spaced along strap 885 while patch 896 is replaced with a second component of the snap fastener (the stud or socket).

Figure 36:
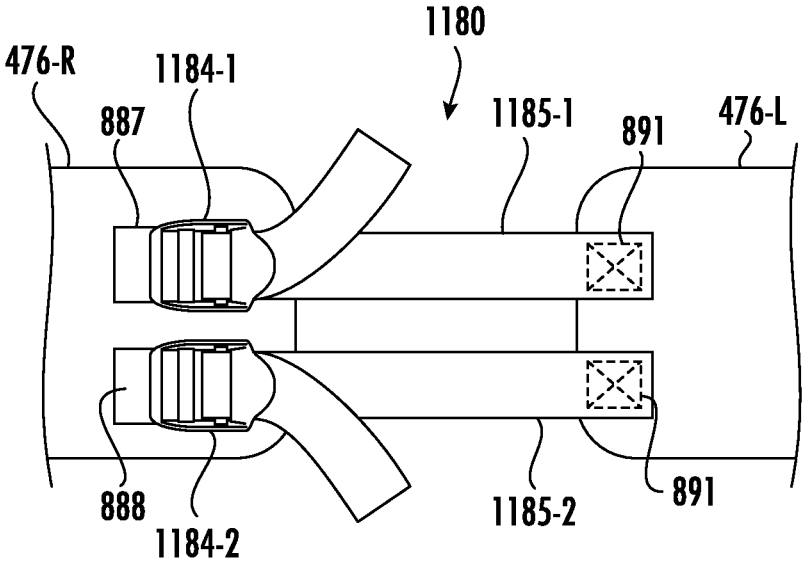
FIG. 36 is a rearview illustrating portions of an example backpack having an example hip belt with rear end portions at a first angle.
Figure 37:
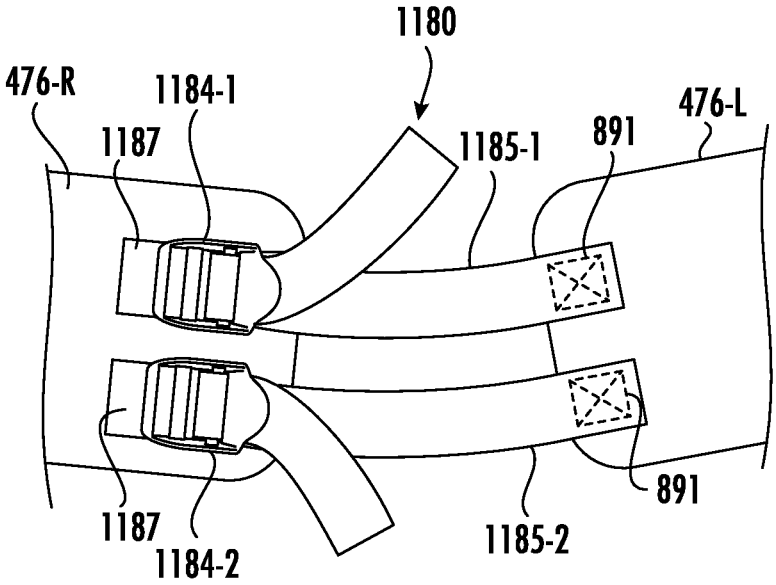
FIG. 37 is a rearview illustrating portions of the example backpack of FIG. 36 with the example rear end portions at a second angle.
Figure 38:
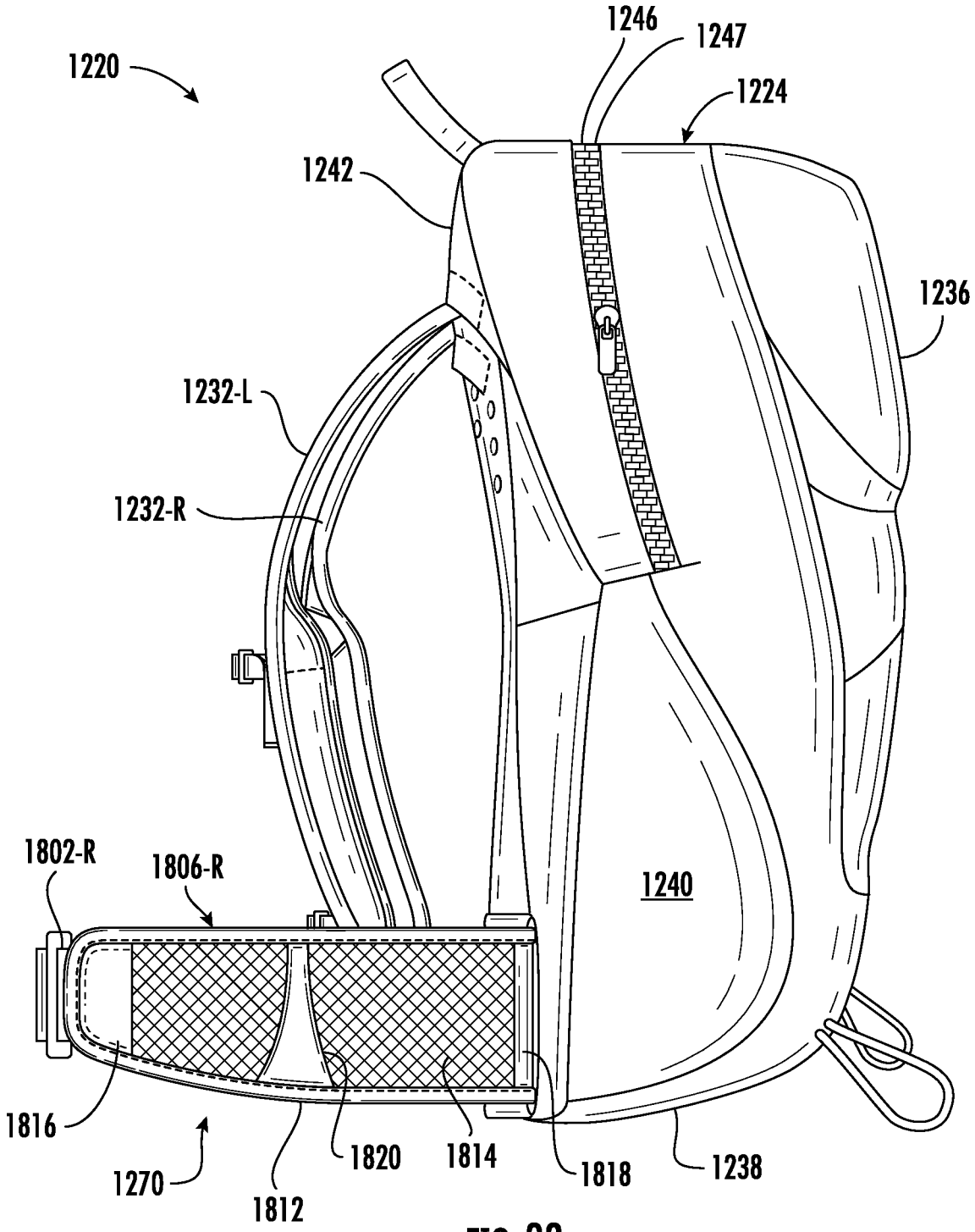
FIG. 38 is a side view of an example backpack.

FIGS. 36 and 37 illustrate portions of an example angle retainer 1180 that may be utilized in place of angle retainer 880 on backpack 820. Angle retainer 1180 is similar to angle 880 except that angle retainer 1180 comprises buckles 1184-1, 1184-2 (collectively referred to as buckles 1184) and connector straps 1185-1, 1185-2 (collectively referred to as straps 1185) in place of turn bars 884-1, 884-2 and connector straps 885-1, 885-2, respectively. Those remaining components of angle retainer 1180 that correspond to components of angle retainer 880 are numbered similarly.

Buckles 1184 are fixed or mounted to rear end portions 476-R. Buckles 1184 receive end portions of straps 1185. In the example illustrated, buckle 1184 are fixed to rear end portions 476-R by loops 887 and stitching 888. In the example illustrated, buckle 1184 comprise ladder lock buckles. Straps 1185 are similar to straps 885 except that straps 1185 omit hook and loop fastener components. In contrast, straps 1185 are each configured to be passed through their respective buckles 1184, wherein the buckle 1184 retain the wrist strap 1185 at selected lengths. Straps 1185 may be slid through their respective buckles 1184 by various extents to permit end portions 476 to be oriented at selected angles relative to one another.

FIG. 36 illustrates angle retainer 1180 retaining end portions 476-R and 476-L at substantially level orientations relative to one another. FIG. 36 illustrates an example state where straps 1185-1 and 1185-2 are substantially equally pulled through buckle 1184-1 and 1184-2 and have substantially equal lengths extending from rear end portions 476-L to buckles 1184. FIG. 37 illustrates angle retainer 1180 retaining end portions 476-R476-L at upward orientations. FIG. 37 illustrates an example state where strap 1185-1 is pulled through its buckle 1184-1 to a greater extent as compared to the extent to which strap 1185-2 is pulled through its buckle 1184-2. Strap 1184 has a length extending from rear end portion 476-L to buckle 1184-1 that is shorter than the length of strap 1185-2 extending from rear end portions 476-R to its buckle 1184-2. As result, rear end portions 476 may accommodate a higher located iliac crest for a better fit.

Separation of straps 885 from their respective buckles 1184 may permit end portions 476 to be separated from one another and to be withdrawn from sleeve 681 for detachment from pack portion 224.

FIGS. 38-43 and 49-55 illustrate portions of an example backpack 1220. Backpack 1220 is an example of a backpack incorporating some of the features described above. Backpack 1220 comprises pack portion 1224, frame 1228 (shown in FIGS. 40 and 41), shoulder straps 1232, hip belt 1270 and angle retainer 1280. Pack portion 1224 is made of a flexible material, such as a canvas or the like. In some implementations, pack portion 1224 may be formed from a flexible material such as a woven textile fabric. In some implementations, the fabric may be coated and/or laminated with at least one water-repellent, water resistant, and/or waterproof material.

Pack portion 1224 comprises a backside 1236, a bottom side 1238, two lateral sides 1240 and a front side 1242 which, when backpack 1220 is worn, facing the back of the person wearing backpack 20. The sides of pack portion 1224 form at least one inner compartment 1244 (shown in FIG. 41 which may accommodate a load to be carried. The inner compartment 1244 may have internal subdivisions. Moreover, the pack portion 1224 may also have outside pockets. Although illustrated as being rectangular, pack portion 24 may have a variety of shapes. Assembly of the panels forming the various sides of pack portion 1224 may be formed by sewing, welding, fusing or the like.

In the example illustrated, pack portion 1224 comprises a top opening 1246 to provide access to the internal compartment 44. In the example illustrated, the top opening 1246 may be closed by zipper 1247. In other implementations, top opening 1246 may be closed by a roll-top type closure or a hem-and-draw-cord type closure. In other implementations other closure mechanisms may be utilized with backpack 20. As should be appreciated, pack portion 1224 may have a variety of different configurations, not limited to an open top backpack.

Figure 39:
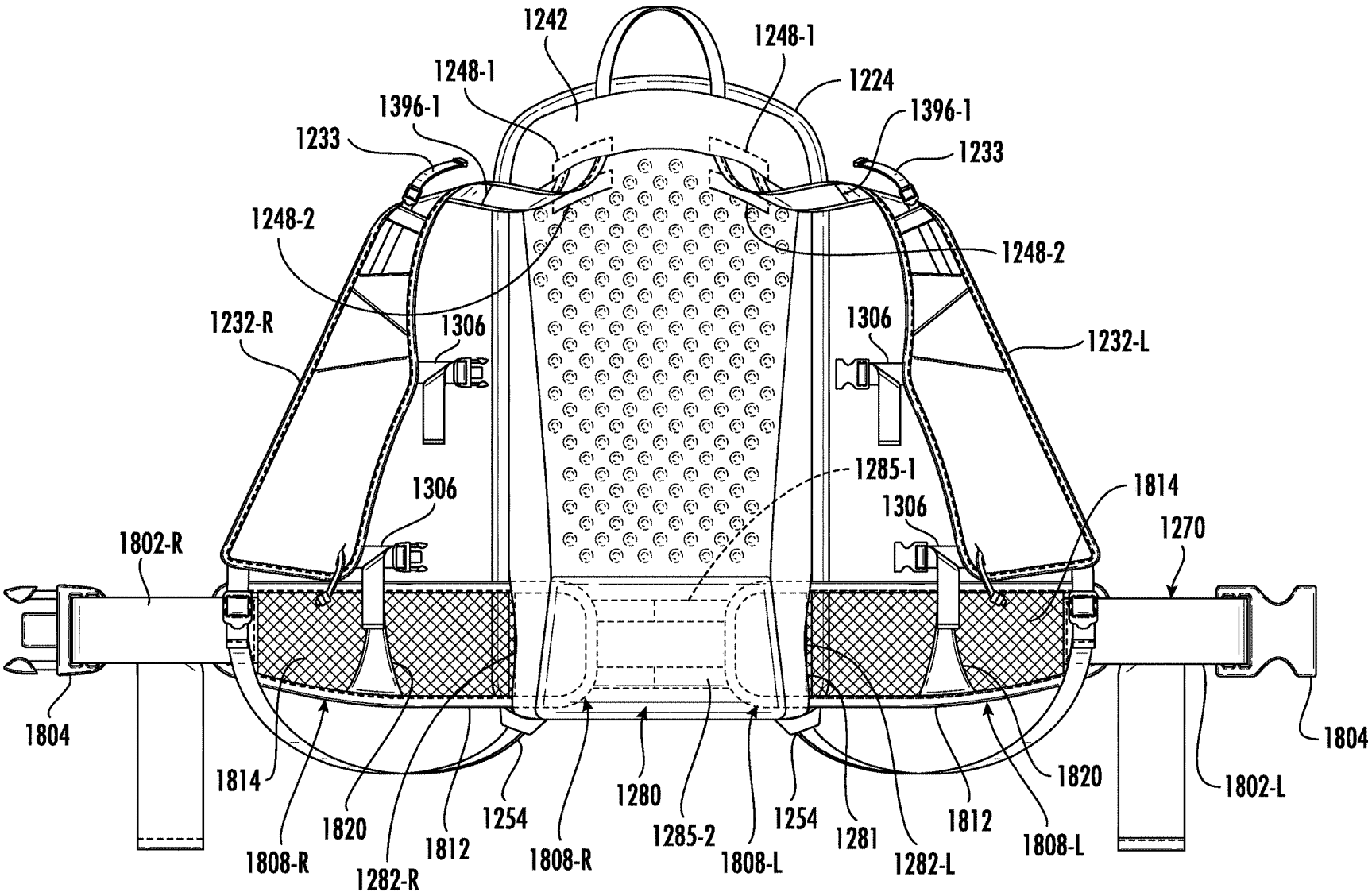
FIG. 39 is a front view of the example backpack of FIG. 38.

Front side 1242 extends opposite to backside 1236. Front side 1242 is sandwiched between frame 1228 and the back of the person to wear backpack 1220. As shown by FIG. 39, front side 1242 comprises an upper pair of slots 1248-1, and a lower pair of slots 1248-2. Each of slots 1248 is sized to permit at least portions of shoulder straps 1232 to pass therethrough.

Frame 1228 (shown in FIGS. 40 and 41) comprises at least one rigid or semi rigid sheet or panel, wherein the sheet or panel is more rigid than the flexible material forming pack portion 1224. Frame 1228 maintains the shape of pack portion 1224 along the back of the person wearing backpack 1220. Frame 1228 further assists in transferring and distributing the load carried by backpack 1220 to the person wearing backpack 1220. Frame 1228 may be formed from materials such as plastics, composite materials, metals and the like. Frame 1228 has an appropriate thickness to exhibit sufficient strength without excessive weight. In some implementations, the structural sheet forming frame 1228 may be formed so as to conform to the shape of the back of the person to wear backpack 1220, either by thermoforming or shaping a reinforcing stay. In some implementations frame 1228 may comprise a layer of foam laminated to the rigid or semi rigid panel.

In the example illustrated, frame 1228 comprises an elongate sleeve 1229 extending along a centerline of frame 1228 and removably receiving a stay 1230. Stay 1230 comprises an elongate rod or bar form from a stiff material such as aluminum. In some implementations, stay 1230 has a rigidity permitting stay 1230 to be manually bent to a desired shape, but enough rigidity to inhibit inadvertent bending or changing of shape when backpack 1220 is being worn. Stay 1230 provides enhanced rigidity along the spine of frame 1228, corresponding to the physical spine of the person wearing backpack 1220. In some implementations, sleeve 1229 and stay 1230 may be omitted.

In some implementations, the rigid or semi rigid sheet or panel forming frame 1228 may have a varying thickness to provide different portions with different degrees of rigidity or stiffness. For example, in some implementations, the rigid or semi rigid sheet may have a thicker region vertically extending along frame 1228 at a lateral midpoint of frame 1228, corresponding to the current location of stay 1230. Such thicker portions may form a frame spine which extends generally opposite to the spine of the person to wear backpack 1220.

Figure 41:
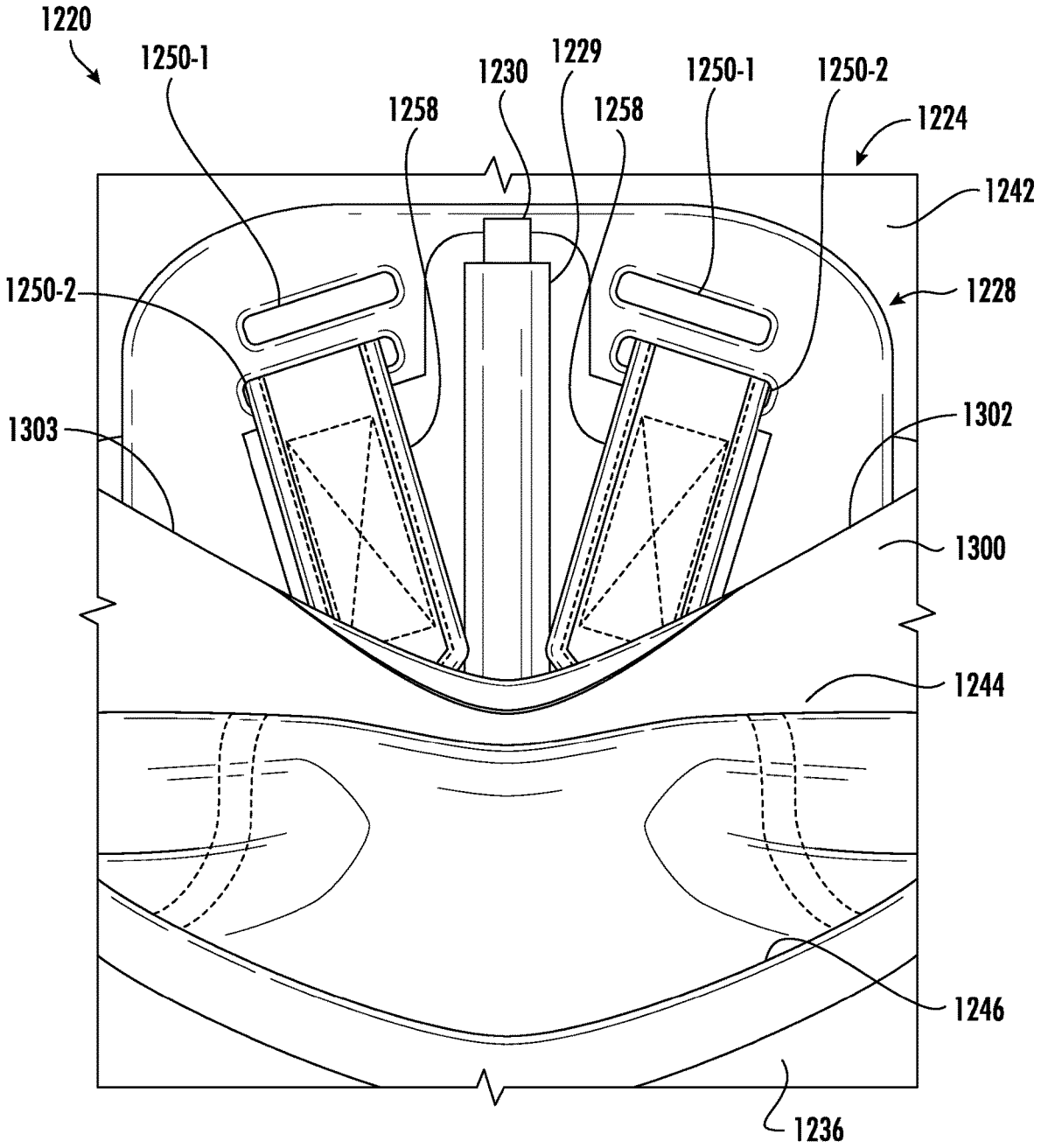
FIG. 41 is a fragmentary perspective view of the example backpack of FIG. 38 illustrating reception of the frame and attached shoulder straps within an example gusset within an interior of an example pack portion.

Frame 1228 is secured to front side 1242 of pack portion 1224, with front side 1242 extending between frame 1228 and the back of the person to wear backpack 1220. As shown by FIG. 41, in the example illustrated, pack portion 1224 comprises a panel 1300 secured to front side 1242 of pack portion 1224, between interior 1244 and front side 1242 so as to form a pocket or gusset 1302 having a top opening 1303 sized to removably receive frame 1228. Gusset 1302 secures and retains frame 1228 along front side 1242 and permits frame 1228 to be removed for repair or replacement of frame 1228 or cleaning or repair of pack portion 1224. In some implementations, frame 1228 may be secured to and within the gusset by adhesive bonding, fastening, welding, stitching and the like or may be secured to front side 1242 while within the gusset. In some implementations, gusset 1302 may be omitted, wherein frame 28 is affixed to front side 1242.

Figure 40:
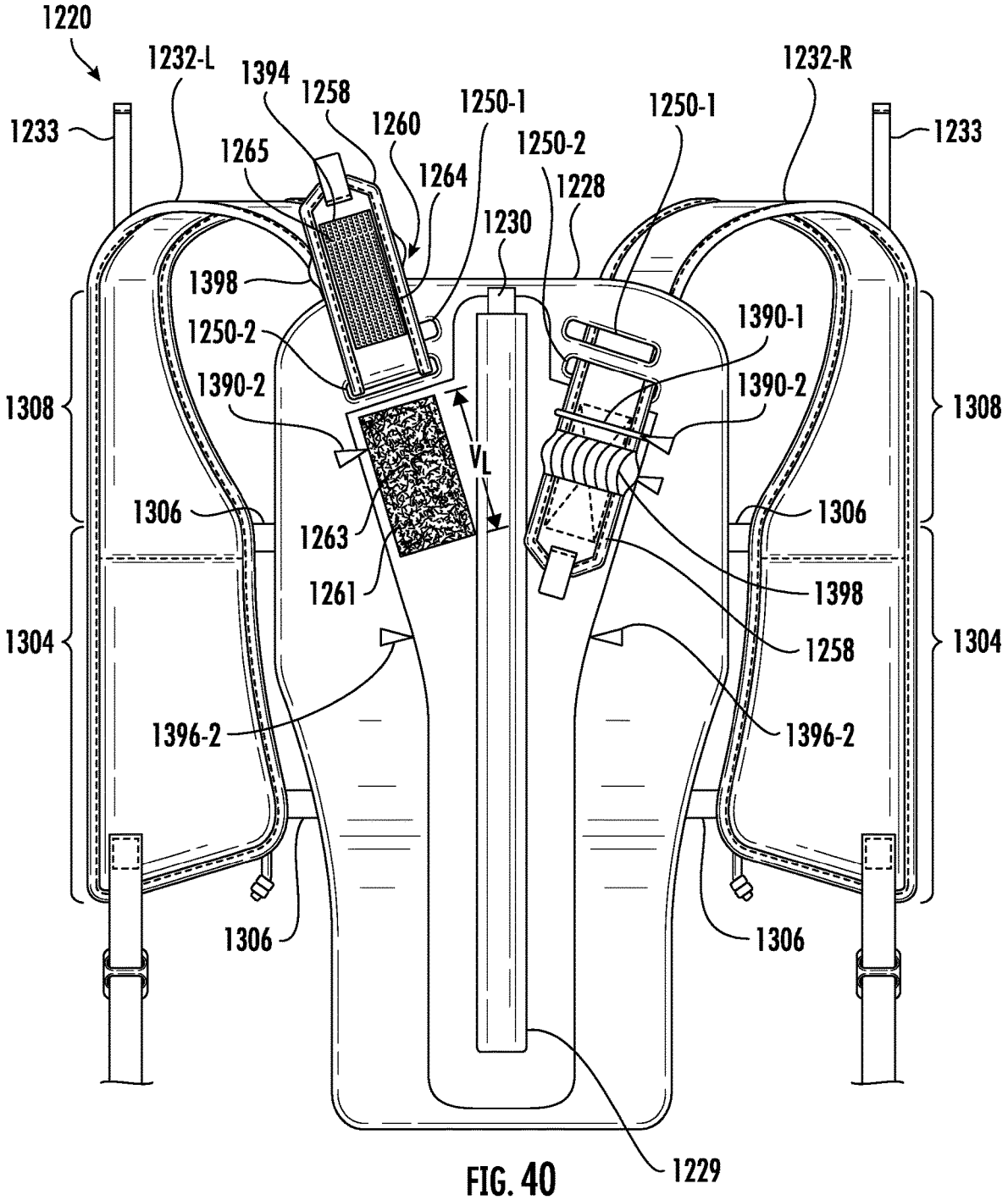
FIG. 40 is a front view illustrating portions of the example backpack of FIG. 38 illustrating example shoulder straps extending through an example frame.

As further shown by FIGS. 40 and 41, frame 1228 comprises an upper pair of slots 1250-1 and a lower pair of slots 1250-2 which extend through frame 1228, wherein each of slots 1250 is sized such that at least portions of shoulder straps 1232 may pass therethrough. Slots 1250-1 are in substantial alignment with slots 1248-1 of front side 1242. Likewise, slots 1250-2 are in substantial alignment with slots 1248-2 of front side 1242. In the example illustrated, slots 1248 and 1250 extend at an angle, being angled downwardly towards lateral sides of backpack 20. In some implementations, slots 1248 and 1250 comprise horizontal slots.

Shoulder straps 1232 serve as a carrying system for backpack 1220. Each of shoulder straps 1232 has a lower end 1254 attached to pack portion 1224, a load stabilizing strap 1233, and a flexible end portion 1258 that passes through one of the aligned slots 1248 and 1250, wherein the flexible end portion 1258 is releasably and adjustably connected to frame 1228 to adjust a length of the flexible end portion 1258 that extends beyond slot 1248, outside of pack portion 1224. In the example illustrated, flexible end portion 1258 comprises a flexible padding.

In the example illustrated, flexible end portion 1258 is adjustably and releasably connected to frame 1228 by hook and loop system 1260 which provides a continuum of different extents that flexible end portion 1258 may extend beyond slots 1248 (shown in FIG. 39). FIG. 40 illustrates one of end portions 1258 released from frame 1228, with the other of and portions 1258 secured to frame 1228. As shown by FIG. 40, flexible end portion 58 is connected to frame 28 at one of a plurality of available connection locations using the hook and loop (VELCRO™) fastener. In the example illustrated, the hook and loop fastener 1260 comprises a first panel or patch 1262 attached to frame 1228 and supporting a first component 1263 (one of hooks or loops) of the hook and loop fastener 1260, and a second panel or patch 1264 attached to the flexible end portion 1258 and supporting a second portion 1265 (the other of the hooks or loops) of the hook and loop fastener 1260. At least one of the panels or patches may have a vertical length to provide multiple connection points. In one implementation, at least one of the panel or patches 1262, 1264 has a vertical length VL of at least 3.5 inches, providing a continuum of different available vertical connection locations along the 3.5 inches.

As shown by FIG. 40, backpack 1220 further comprises maximum extension indicators 1390-1, 1390-2 indicating a recommended maximum extent to which the flexible end portion 1258 may extend beyond the first slot. Indicator 1390-1 is formed on flexible end portion 1258 of each of shoulder straps 1232. Indicators 1390-1 may comprise a change in color, a line of stitching, a coating or marketing, or any other visually perceptible Mark that is located on each of shoulder straps 1232 at a location corresponding to the maximum extent to which the flexible end portion 1258 may extend beyond slots 1248-1 or slots 1248-2. For example, a person using backpack 1220 and adjusting the length of a particular shoulder strap 1232 may be instructed that the indicators 1390-1 should not be exposed beyond slot either slots 1248. Alternatively, the person using backpack 1220 and adjusting the length of their shoulder strap 1232 may be instructed that the indicators 1390-1 should always remain visible on the backside of frame 1228, exposed beyond either of slots 1250.

Maximum extension indicators 1390-2 are formed on frame 1228 indicating a recommended maximum extent to which the flexible end portion 1258 may extend beyond the first slot. Indicators 1390-2 may comprise a change in color, a line of stitching, a coating or marketing, text, or any other visually perceptible mark that is located patch 1262 at a location corresponding to the maximum extent to which the flexible end portion 1258 may extend beyond slots 1248-1 or slots 1248-2. For example, a person using backpack 1220 may be instructed that the shoulder strap 1232 should not be positioned such that the edge 1394 of patch 1264 should not be positioned between the indicators 1390-2 and either of slots 1250. In some implementations, maximum extension indicators 1390 may be omitted.

As shown by FIG. 40, backpack 1220 further comprises a maximum retraction indicators 1396-1, 1396-2 indicating a recommended maximum extent to which the flexible end portion 1258 may be retracted through the one of slots 1248. Indicators 1396-1 (shown in FIG. 39) are formed on flexible end portion 1258 of each of shoulder straps 1232, indicating a recommended maximum extent to which the flexible end portion of the shoulder strap may be retracted into the pack portion. For example, a person using backpack 1220 may be instructed that the length of a shoulder strap 1232 should not be adjusted such that indicators 1396-1 is no longer visible beyond either of slots 1248.

Maximum retraction indicators 1396-2 are formed on frame 1228 indicating a recommended maximum extent to which the flexible end portion 1258 may be retracted into pack portion 1224. Indicators 1396-2 may comprise a change in color, a line of stitching, a coating or marketing, text, or any other visually perceptible mark that is located on frame 1228 at a location corresponding to the maximum extent to which the flexible end portion 1258 may be retracted and extended along frame 1228. For example, a person using backpack 1220 may be instructed that the shoulder strap 1232 should not be positioned such that the edge 1394 of patch 1264 should not be positioned past the indicators 1396-2. In some implementations, maximum retraction indicators 1396 may be omitted.

Lastly, as shown by FIG. 40, backpack 220 may further comprise an extension stop 1398 provided on the flexible end portion 1258 of each of the shoulder strap 1232. Each extension stop 1398 may be configured to resist movement of the extension stop through either of slots 1250. In some implementations, the extension stops 1398 do not prevent withdrawal of flexible and portion 1258 from either of slots 1248. However, extension stop 1398 may inhibit inadvertent passage of flexible end portions 1258 through slots 1250 and 1248. In the example illustrated, extension stop 1398 each comprise a portion of flexible end portion 1258 that are dimensioned slightly larger than the dimensions of slots 1248 or 1250, but which are flexible or compressible so as to be pulled through slots 1248 and 1250 with sufficient force. In some implementations, extension stops 1398 comprise enlarged padding or padded fabric bumps dimension larger than corresponding dimensions of slots 1248, 1250. In some implementations, extension stops 1398 may be omitted.

Figure 42:
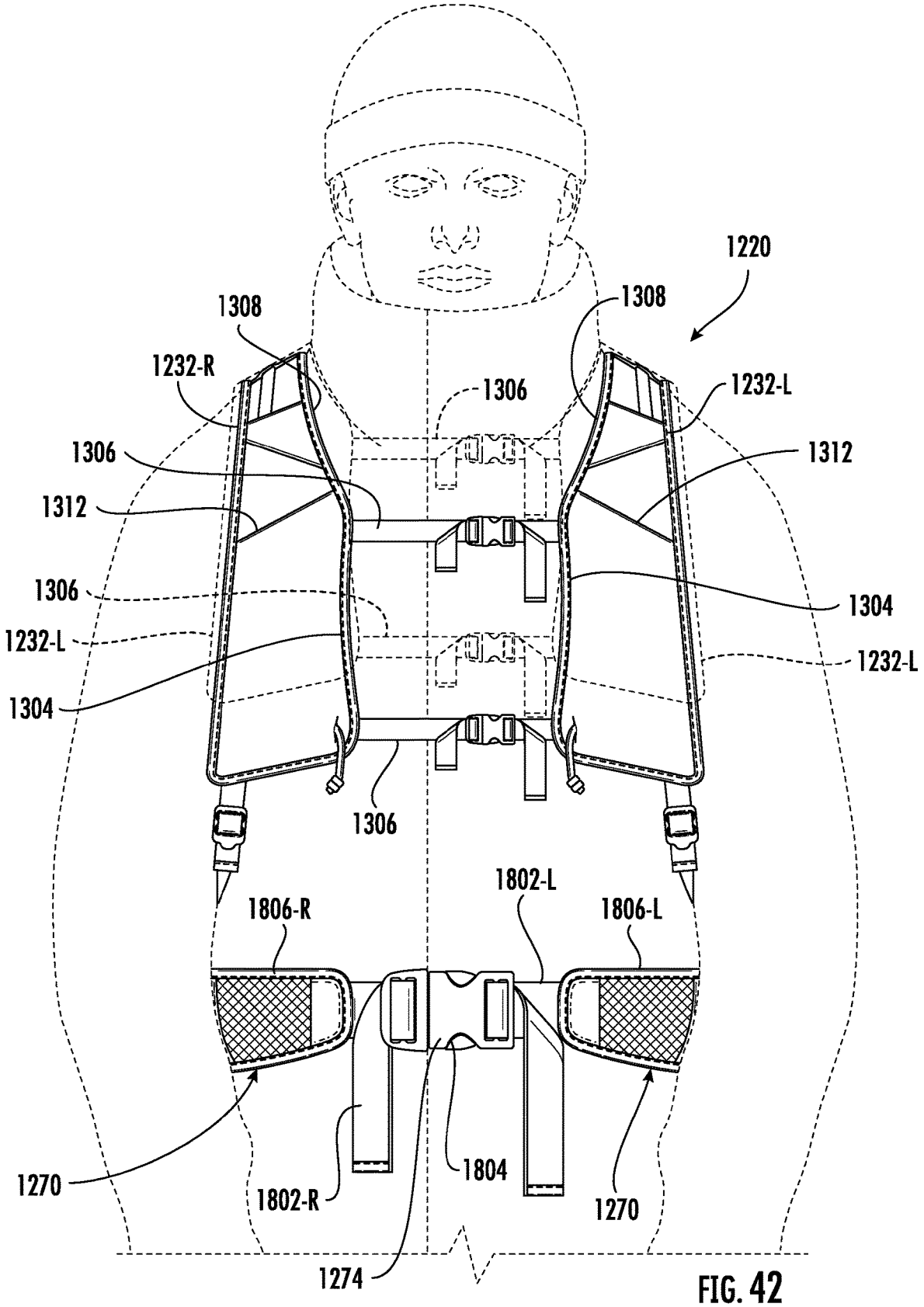
FIG. 42 is a front view of the example backpack of FIG. 38 being worn by an example person.
Figure 43:
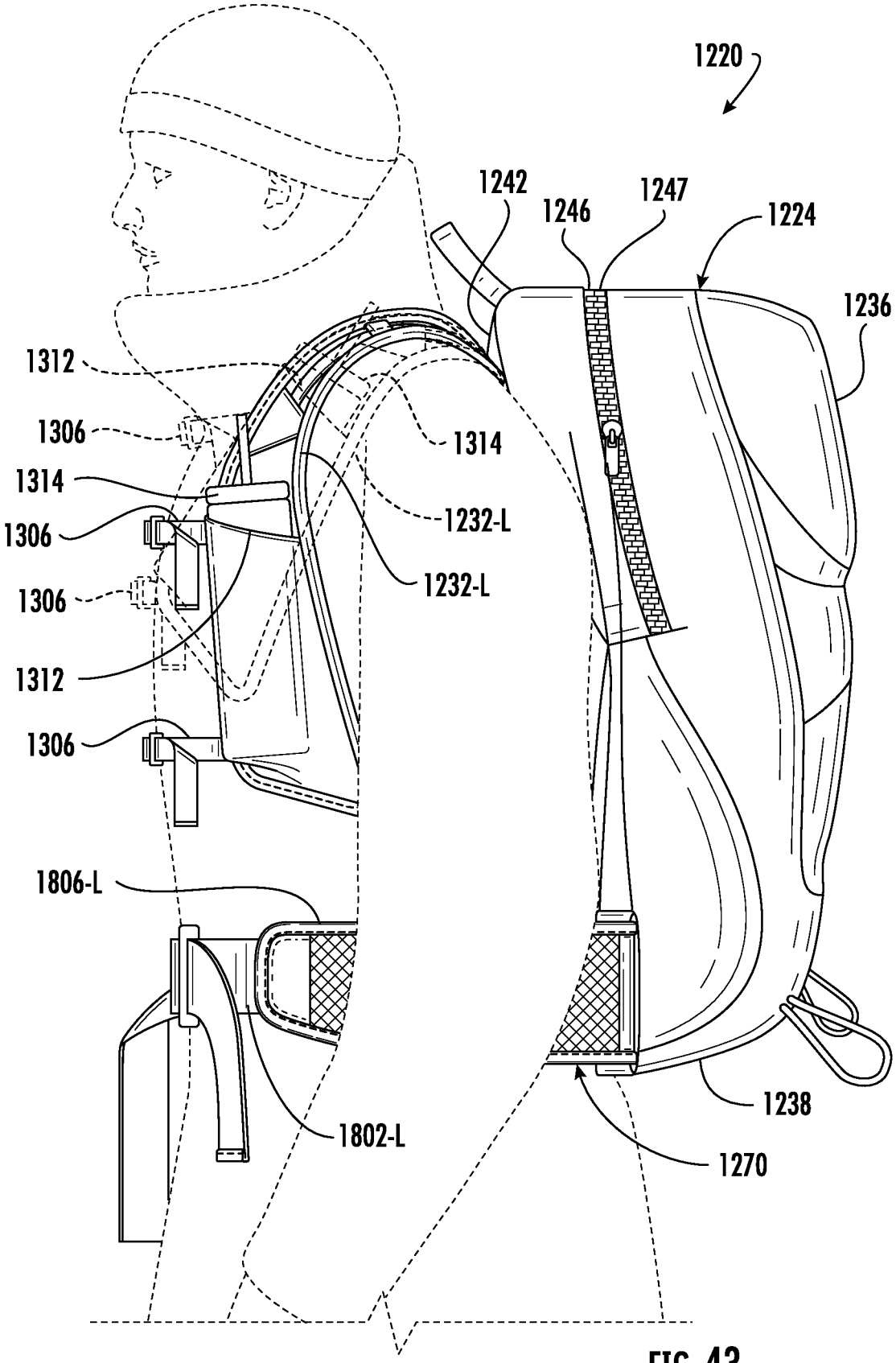
FIG. 43 is a side view of the example backpack of FIG. 38 being worn by the example person.

FIGS. 42 and 43 illustrate shoulder straps 1232 adjusted to two different lengths extending beyond slots 1248-2. FIGS. 42 and 43 illustrate shoulder straps 1232 having a first length (shown in broken lines) and a second adjusted length (shown in solid lines). As shown by FIG. 40, each of shoulder straps 1232 comprises a lower and wider chest portion 1304 from which sternum straps 1306 extend and an upper and narrower neck portion 1308 adapted to widen the spacing or opening between shoulder straps 1232 to accommodate the neck of the person wearing backpack 1220 or the neck collar of any garment worn by the person. However, as shown by broken lines, with the first shorter length shown in broken lines, the person's shoulders may be sufficiently thick (front to back) such that the wider chest portions 1304 uncomfortably press against the person's neck or garment collar.

As further shown by FIG. 42, with the first length shown in broken lines, the sternum straps 1306 may uncomfortably extend too close to the person's neck. Moreover, the sternum straps 1306 may extend across the person's chest at uncomfortable locations. This may be especially uncomfortable for females.

The length adjustability of shoulder straps 1232 solves such problems. To address such problems, each of shoulder straps 1232 may be released from frame 1228, disconnecting hook and loop systems 1260. Each of shoulder straps 1232 may then be further pulled through slots 1248-2 and 1250-2 to provide shoulder straps 1232 with a longer length extending over the shoulders of the person wearing backpack 1220. The selected longer length may be retained by reconnecting shoulder straps 1232 to frame 1228 at the selected location by once again positioning hook and loop components 1263 and 1265 into connection with one another. As shown in solid lines, extending the length of shoulder straps 1232 lowers sternum straps 1306 to potentially more comfortable locations across the chest of the person wearing backpack 1220.

As shown by FIG. 43, the length adjustability of shoulder straps 1232 may additionally facilitate repositioning of any pockets that may be provided by shoulder straps 1232. In the example illustrated, chest portions 1304 of shoulder straps 1232 additionally comprise pockets 1312 for containing articles, such as the illustrated water bottle 1314. As shown in broken lines, water bottle 1314 may be too "high" when the person has thicker shoulders. As shown in solid lines, by lengthening shoulder straps 132, the pocket 1312 and the carried water bottle 1314 may be lowered to a more accessible height.

Although FIGS. 42 and 43 illustrate flexible end portion 58 of shoulder straps 32 as having two available states or extents to which flexible end portion 58 projects beyond slot 48, in some implementations, flexible end portion 58 of shoulder strap 32 may have multiple available extended/retracted states. In some implementations, the extent to which flexible end portion 58 projects beyond slot 48, outside of pack portion 24, may be adjusted along a continuum of available extents. In some implementations, the extent to which flexible end portion 58 projects beyond slot 48, outside of pack 24, may be adjusted amongst a plurality of discrete, predefined extents.

Figure 44:
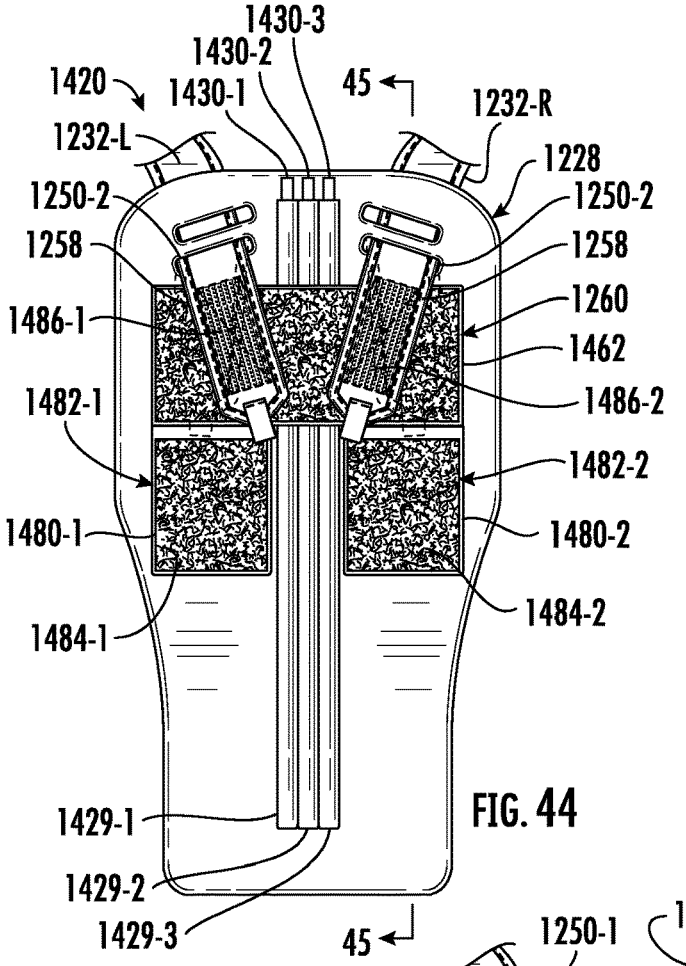
FIG. 44 is a rearview illustrating portions of an example backpack illustrating example shoulder straps extending through an example frame and releasably attached to a back face of the example frame with example flaps in an unfolded, extended state.
Figure 45:
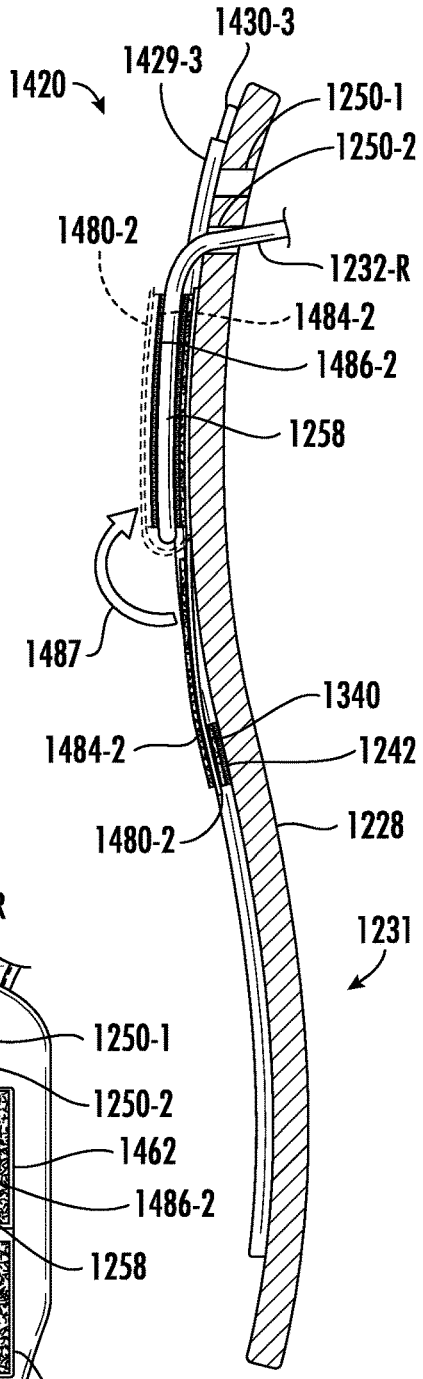
FIG. 45 is a sectional view of the example backpack of FIG. 44 taken along line 45-45.

FIGS. 44 and 45 illustrate portions of an example backpack 1420. FIGS. 44 and 45 illustrate another example of how the flexible end portions of the shoulder straps 1232 may be releasably secured to the backpack frame 1228 at different positions to adjust a length of the shoulder straps 1232. Backpack 1420 is similar to backpack 1220 except that backpack 1420 comprises sleeves 1429-1, 1429-2, 1429-3 (collectively referred to as sleeves 1429) and stays 1430-1, 1430-2 and 1430-3 (collectively referred to as stays 1430) in place of sleeve 1229 and stay 1230. Sleeves 1429 are fixed to frame 1228 and removably receive stays 1430.

Stays 1430 are each similar to stay 1230. Stays 1430 are slidably received within sleeves 1429. Each of stays 1430 comprises an elongate rod or bar form from a stiff material such as aluminum. In some implementations, each of stays 1430 has a rigidity permitting stay 1230 to be manually bent to a desired shape, but enough rigidity to inhibit inadvertent bending or changing of shape when backpack 1420 is being worn. Each of stays 1430 provides enhanced rigidity along the spine of frame 1228, corresponding to the physical spine of the person wearing backpack 1220. In the example illustrated, some or all of stays 1430 may be removed from sleeves 1429 to adjust the stiffness or rigidity of frame 1228. Although three sets of sleeves and stays are illustrated, in other implementations, backpack 420 may comprise any number of sleeves and stays or may omit such sleeves and stays.

As further shown backpack 420 additionally comprises patch 1462 in place of patch 1262 and comprises flaps 1480-1, 1480-2 (collectively referred to as flaps 1480) and hook and loop fasteners 1482-1, 1482-2 (collectively referred to as fasteners 1482). Patch 1462 replaces patch 1262 as part of a hook and loop fastener 1260. Patch 1462 comprises a first component 1263 of the hook and loop fastener 1260. In contrast to patch 1262, patch 1462 is sufficiently large so as to be attachable to the flexible end portions 1258 of both of shoulder straps 1232-L, 1232-R. Patch 1462 is sufficiently large such that flexible end portions 1258 may be mounted to patch 1462 at a multitude of different selectable positions and angles.

Flaps 1480 comprise panels pivotally connected to the sheet forming frame 1228 below patch 1462. Flap 1480-1 is pivotable between a first position in which flap 1480-1 extends below patch 1462 and a second position in which flap 1480-1 overlaps portions of patch 1462 with flexible end portion 1258 of shoulder strap 1232-L sandwiched therebetween. Likewise, flap 1480-2 is pivotable between a first position in which flap 1480-2 extends below patch 1462 and a second position in which flap 1480-2 overlaps portions of patch 1462 with flexible end portion 1258 of shoulder strap 1232-R sandwiched therebetween.

Hook and loop fasteners 1482-1 and 1482-2 comprise patches 1484-1, 1484-2 (collectively referred to as patches 1484) and patches 1486-1, 1486-2 (collectively referred to as patches 1486), respectively. Patches 1484-1, 1484-2 are mounted to or supported by flaps 1480-1, 1480-2, respectively, and comprise patches of a first component of a hook and loop fasteners 1482-1, 1482-2. Patches 1486-1, 1486-2 are mounted to or supported by flexible end portions 1258 of shoulder straps 1232-L, 1232-R, respectively, and comprise patches of a second component of the hook and loop fasteners 1482-1, 1482-2.

As shown by FIG. 45, once the flexible end portion 1258 of shoulder strap 1232-R has been moved through its respective slot 1250-2 in frame 1228 (and through its respective slot 1248-2 in pack portion 1224) and has been attached to frame 1228 through the interconnection of patches 1264 and 1462, flap 1480-2 may be pivoted in an upward direction as indicated by arrow 1487 to sandwich flexible end portion 1258 between frame 1228 and flap 1480-2. In the sandwiched position shown in broken lines, the hook or loop component of patch 1484-2 inter meshes and connects with the loop or hook components of patch 1486-2 to further secure flexible end portion 1258 of shoulder strap 1232-R in place and to retain show strap 1232-R with the selected length projecting from or beyond slot 1248-2. Flexible end portion 1258 of shoulder strap 1232-L may be secured to frame 1228 and sandwiched between frame 1228 and flap 1480-1 in a similar fashion.

In some implementations, flaps 1480 may have faces, opposite to patches 1484, that are releasably connected to frame 1228. For example, in some implementations, such faces may include a first patch 1340 of a first component of a hook and loop fastener, wherein frame 1228 comprises a second patch 1342 of a second component of the hook and loop fastener. In such implementations, flaps 1480 may be retained in unfolded or un-sandwiching states to provide a larger area for greater length adjustment of shoulder straps 1232-L, 1232-R. For example, in such implementations, patches 1264 may be intermeshed and connected to patches 1484 to provide an even shorter length for shoulder straps 1232. In some implementations, patches 1264 may be sufficiently long so as to concurrently connect to both of patches 1462 and the respective one of patches 1484.

In circumstances where the shoulder straps 1232 are provided with a greater length, potentially reducing the extent to which the hook and loop fasteners of patches 1264 overlap and connect to those of patch 1462, flaps 1480 may be pivoted for additional connection robustness. In some implementations, patches 1340 and 1342 may be omitted, wherein patches 1484 are not utilized to provide additional surface area for additional length adjustment of shoulder straps 1232. In some implementations, the hook and loop fastener components may be replaced with other components. For example, each of the hook and loop fasteners may be replaced with a series of spaced snaps or other connectors.

Because flaps 1480 are independently pivotable, the length of the individual shoulder straps 1232 may be adjusted independent of one another. For example, the length of shoulder strap 1232-L may first be adjusted and secured in place followed by the pivoting of flap 1480-1 to sandwich flexible end portion 1258 of shoulder strap 1232-L. Thereafter, the length of shoulder strap 1232-R may be adjusted and secured in place followed by the pivoting of flap 1480-2 to sandwich flexible end portion 1258 of shoulder strap 1232-R.

Figure 46:
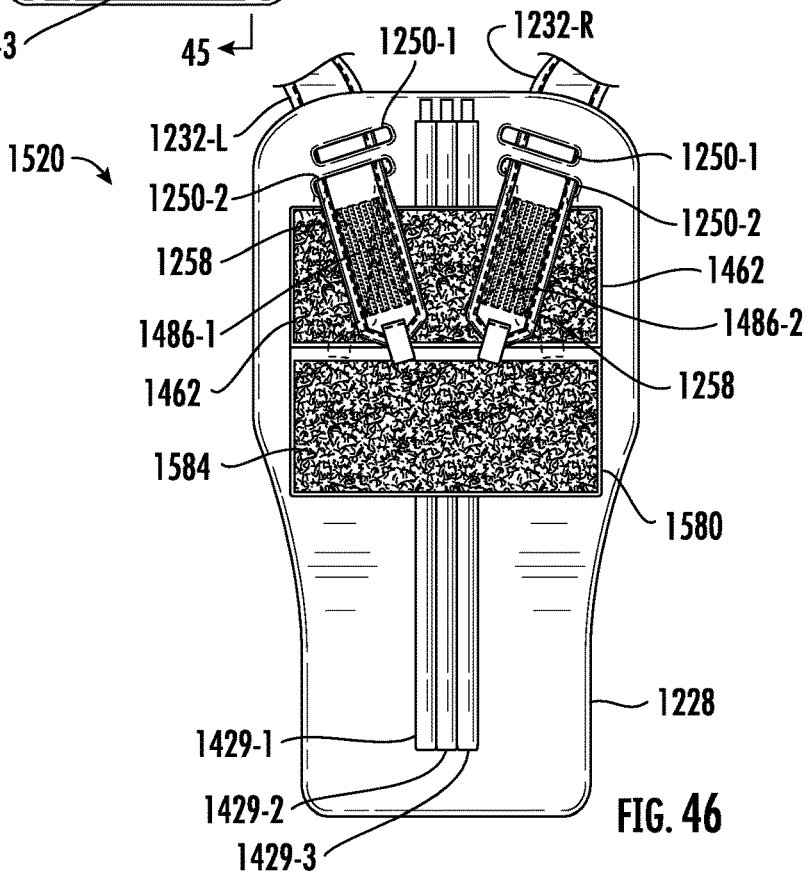
FIG. 46 is a rearview illustrating portions of an example backpack illustrating example shoulder straps extending through an example frame and releasably attached to a back face of the example frame with an example flap in an unfolded, extended state.

FIG. 46 illustrates portions of an example backpack 1520. Backpack 1520 is similar to backpack 1420 in all respects except that backpack 1520 comprises a single flap 1580, replacing flaps 1480-1 and 1480-2. Flap 1580 carries a single patch 1584 of a component of hook and loop fastener system 1482. Like each of flaps 1480, flap 1580 may be pivoted from the extended position shown to a folded or sandwiching position (similar to that shown in FIG. 45) at which flexible end portion 1258 are connected on both faces, being connected to patch 1462 on a first face and being connected to flap 1580 on a second face by hook and loop fasteners. The single flap 1580 facilitates concurrent connection of flap 1582 both of shoulder straps 1232.

As discussed above, in some implementations, the hook and loop fastener may be replaced with other connection mechanisms, such as a series of snaps or the like. As discussed above, in some implementations, flap 1580 may be releasably secured to frame 1228 by its own set of connectors, such as with patches 1340, 1342 of a hook and loop fastener or with one or more snaps. In the extended position shown in FIG. 46, patches 1264 of flexible end portions 1258 of shoulder straps 1232 alternatively be connected to patch 1584 for additional length adjustment. In some implementations, patches 1264 may be sufficiently long so as to concurrently connect to both of patches 1462 and 1584. In circumstances where shoulder straps 1232 are to be provided with a greater length projecting from slots 1248-1 or slots 1248-2, patches 1264 may be secured to patch 1462 and flap 1580 may be pivoted to a sandwiched state or position for enhanced securement.

Figure 47:
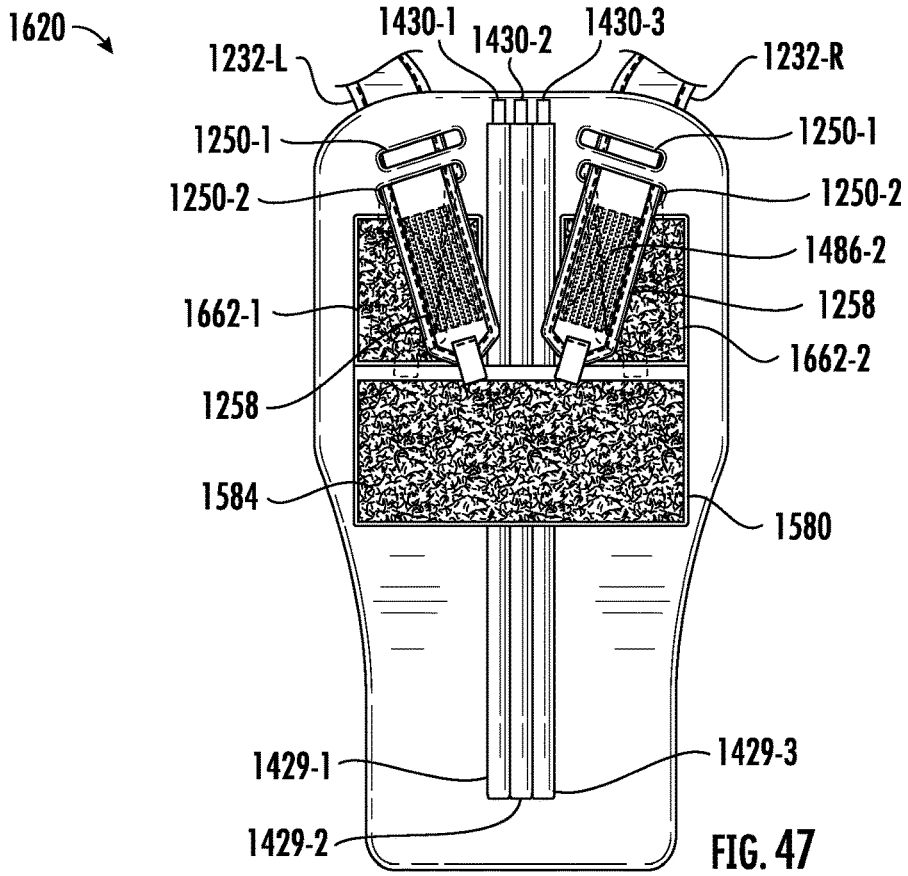
FIG. 47 is a rearview illustrating portions of an example backpack illustrating example shoulder straps extending through an example frame and releasably attached to a back face of the example frame with an example flap in an unfolded, extended state.

FIG. 47 illustrates portions of an example backpack 1620. Backpack 1620 is similar to backpack 1520 in all respects except that backpack 1620 comprises a pair of patches 1662-1, 1662-2, replacing the single patch 1462. Those remaining portions of backpack 1620 which correspond to components of backpack 1520 are numbered similarly. As shown by FIG. 47, patches 1662 are sufficiently large such that flexible end portion 1258 of shoulder straps 1232 may be positioned at a variety of different positions and angles.

Figure 48:
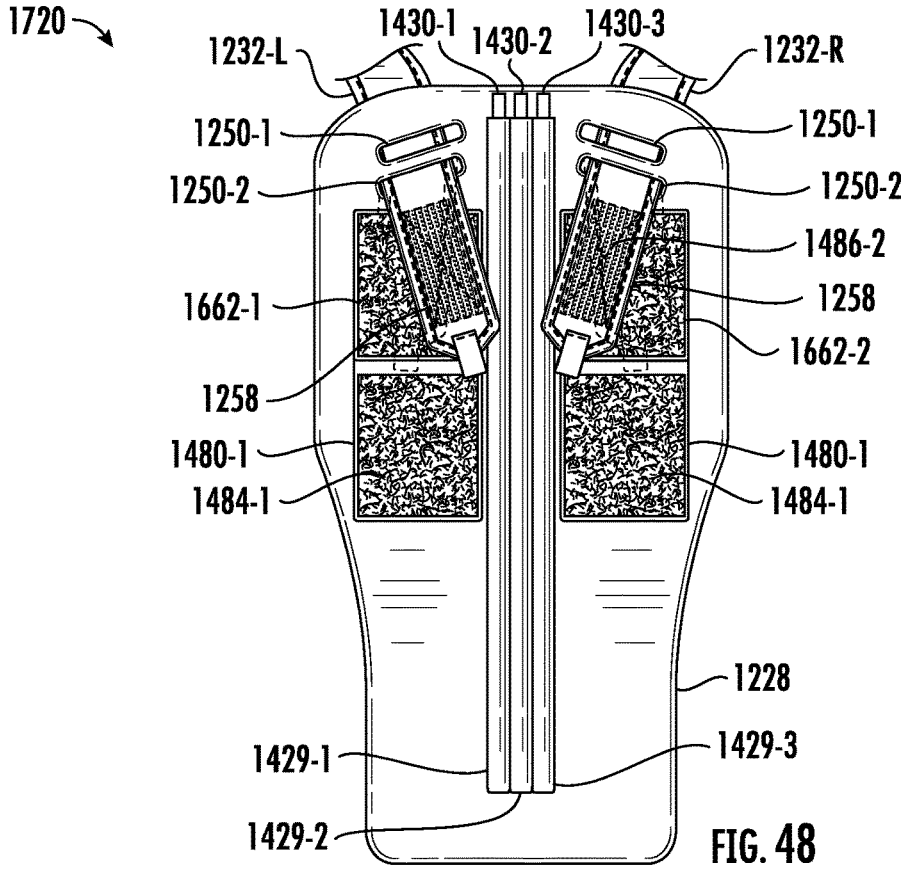
FIG. 48 is a rearview illustrating portions of an example backpack illustrating example shoulder straps extending through an example frame and releasably attached to a back face of the example frame with example flaps in an unfolded, extended state.

FIG. 48 illustrates portions of an example backpack 1720. Backpack 1720 is similar to backpack 1420 in all respects except that backpack 1720 comprises the pair of patches 1662-1, 1662-2, replacing the single patch 1462. Those remaining portions of backpack 1720 which correspond to components of backpack 1420 are numbered similarly. As shown by FIG. 47, patches 1662 are sufficiently large such that flexible end portion 1258 of shoulder straps 1232 may be positioned at a variety of different positions and angles.

Figure 49:
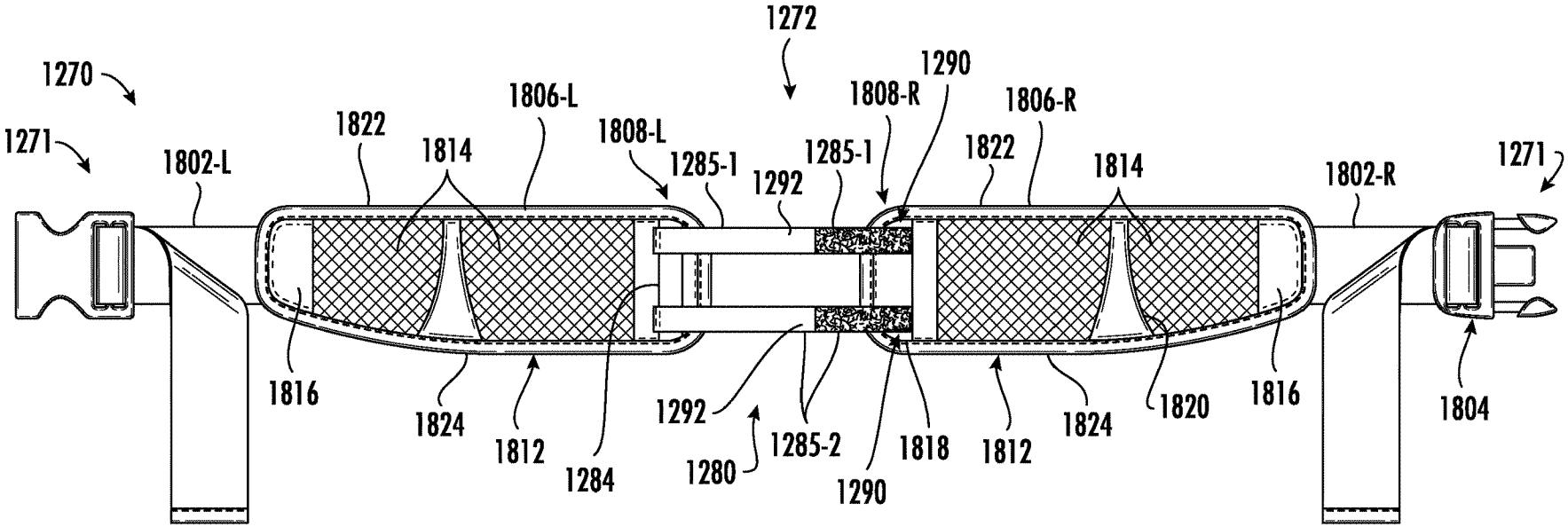
FIG. 49 is a rearview of an example hip belt of the backpack of FIG. 38 illustrating side panels of the example hip belt at a first angle.
Figure 50:
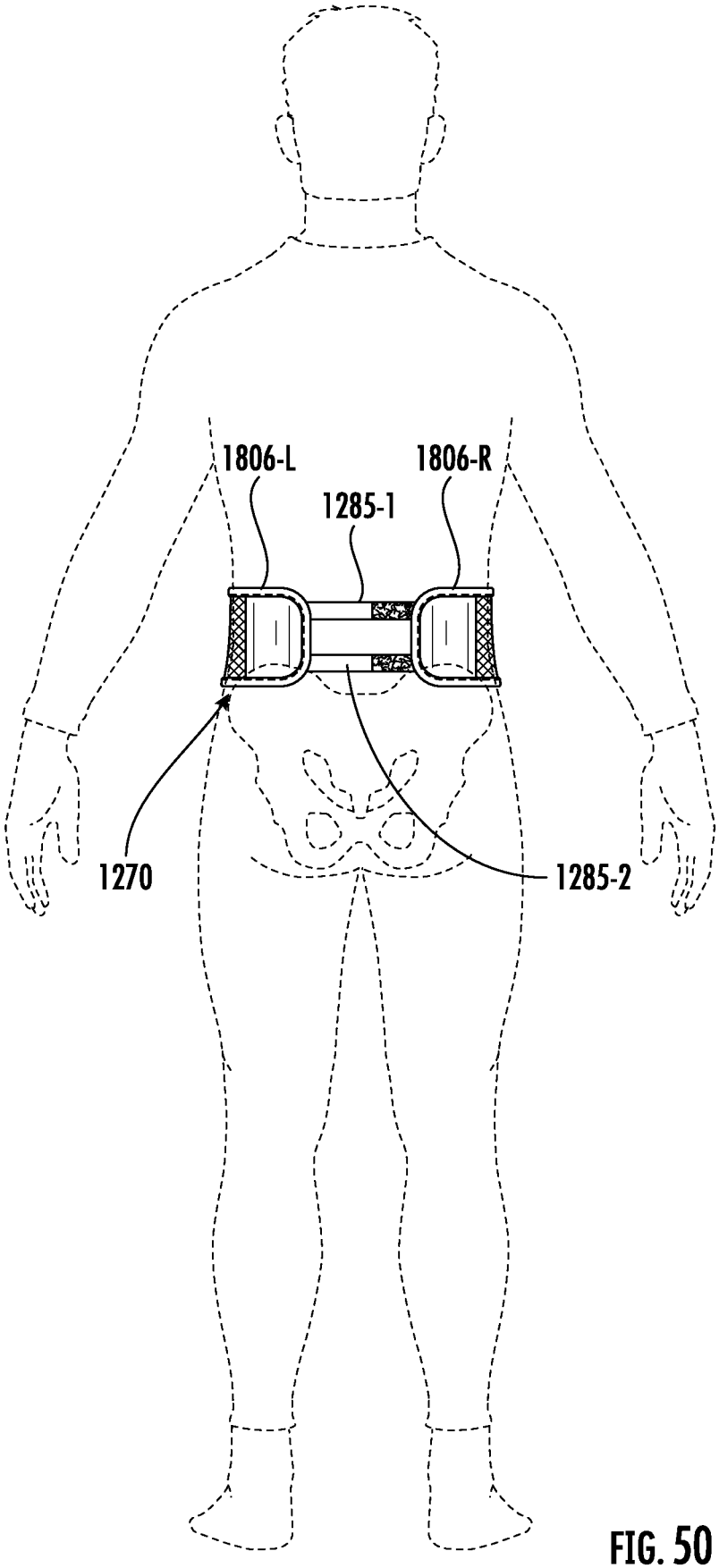
FIG. 50 is a rearview of the example hip belt of FIG. 49 being worn by an example person.

FIGS. 49-55 illustrate portions of the example hip belt 1270 which is part of backpack 1220 and is likewise part of backpacks 1420, 1520, 1620, and 1720. As shown by FIG. 49, hip belt 1270 comprise a belt configured to wrap or extend about the waist region of the person wearing backpack 1220. Hip belt 1270 comprises front adjustment straps 1802-L, 1802-R (collectively referred to as front adjustment straps 1802), front connector 1804, and side panels 1806-L, 1806-R (collectively referred to as side panels 1806). Front adjustment straps 1802 extend from side panels 1806 to connector 1804. Front adjustment straps 1802 form a front side of belt 1270 and cooperate with connector 1804 to provide for length adjustment of belt 1270. In the example illustrated, connector 1804 comprises a side-release buckle. In other implementations, connector 1804 may comprise other forms of buckles or other forms of connectors that releasably join front adjustment straps 1802-L and 1802-R to one another along a front of the person wearing backpack 1220.

Side panels 1806 extend between front adjustment straps 1802 and angle retainer 1280. Side panels 1806 each wrap about the sides of the person wearing backpack 1220 and terminate in regions proximate to a back of the person wearing backpack 1220, forming a portion of rear side of belt 1270. Side panel 1806-L forms a left rear end portion 1808-L. Side panel 1806-R forms a right rear end portion 1808-R.

In the example illustrated, side panels 1806 are similar to one another but for their differing connections to angle retainer 1280. Each of side panels 1806 comprises outer frame 1812, middle mesh 1814, front end support 1816, rear end support 1818 and middle support 1820. Outer frame 1812 forms an outer perimeter of each of side panels 1806. Outer frame 1812 comprises an upper rigid band 1822 and a lower rigid band 1824. The upper rigid band 1822 and the lower rigid band 1824 of side panel 1806-L extends to the rear left end portion 1808-L. The upper rigid band 1822 and the lower rigid band 1824 of the side panel 1806-R extend to the rear right end portion 1808-R.

Middle mesh 1814 comprises a mesh or netting extending within outer frame 1812, connecting portions of upper rigid band 1822 and lower rigid band 1824. In the example illustrated, middle mesh 1814 is perforate, providing breathability and providing enhanced flexibility. Middle mesh 1814 has a greater degree of deform ability or flexibility as compared to outer frame 1812. In some implementations, middle mesh 1814 is resiliently flexible. Middle mesh 1814 is flexible so as to be deformable away from outer frame 1812 and form a softer region containing the iliac crest of the hip cage of the person wearing the hip belt. As result, the hip belt 1270 may be more reliably and comfortably positioned relative to the iliac crest and hip cage of the person wearing the hip belt 1270 and backpack 1220.

Front end supports 1816 comprise panels or other structures at an end of each of side panels 1806 proximate to the front adjustment straps 1802. Rear end supports 1818 comprises panels other structures at an end of each of side panels 1806 proximate to angle retainer 1280. Middle supports 1820 comprise panels or other structure centrally located between the front and supports 1816 and the rear end supports 1818 of side panels 1806. Each of supports 1816, 1818 and 1820 may comprise foam panels or panels of other materials that provide such panels with a stiffness greater than that of mesh 1814. Supports 1816, 1818 and 1820 assist in maintaining mesh 1814 in a taught state. Middle supports 1820 inhibit curling of upper rigid band 1822 and lower rigid band 1824. In the example illustrated, middle supports 1820 is in the form a triangle having a wider base connected to and extending along lower rigid. As result, middle supports 1820 provides enhanced resistance of the lower rigid band 1824 when belt 1270 is being worn.

Angle retainer 1280 facilitates relative angular adjustment of side panels 1806 and their end portions 1808 and retains such side panels 1806 at selected relative angles. In the example illustrated, angle retainer 1280 comprises a turn bar 1284 and connector straps 1285-1 and 1285-2 (collectively referred to as straps 1285). Turn bar 1284 comprise a strap or band having ends secured to or formed as part of rear end portion 1808-L. Turn bar 1284 provides a structure about which free ends of straps 1285 may turn and wrap to releasably connect rear end portion 1808-R to rear end portions 1808-L. In other may have a configuration similar to the turn bars 84, 984 and 1084 shown in FIGS. 31, 34 and 35.

Straps 1285 extend from rear end portion 1808-R and wrap about turn bar turn bar 1284 before being releasably connected to themselves. Straps 1285 are similar to straps 885 of backpack 820 described above. Each of straps 1285 has a fixed end portion 1290 attached to rear end portion 1808-R by stitching and an opposite free end portion 1292. Free end 1292 comprises patch 894 (shown in FIG. 35) of a first component (hooks or loops) of a hook and loop fastener and a patch 896 (shown in FIG. 35) of a second component (loops or hooks) of the hook and loop fastener. At least one of patches 894, 896 has a length along its respective strap 885 to facilitate releasable attachment of free end 892 to itself in a plurality of available locations. In such an implementation, the free end 1292 of the strap 1285 may be fed through and wrapped about the turn bar 884 to reverse in direction and to attach to itself, after passing around turn bar 1284, using the two patches 894, 896.

As shown by FIGS. 49-53, by varying the extent to which the two straps 1285 turnabout the turn bars 1284 and the locations of the self-attachments, the lengths of the two straps 1285 between the end portions 1808 may be adjusted and varied to retain the side panels 1806 at any one of multiple relative angles. FIG. 49 illustrates both of straps 1285 having equal extents or lengths wrapped about turn bars 1284 such that side panels 1806 are substantially level relative to one another. The level orientation of accommodate persons with particular iliac crests such as those shown in FIG. 50.

Figure 51:
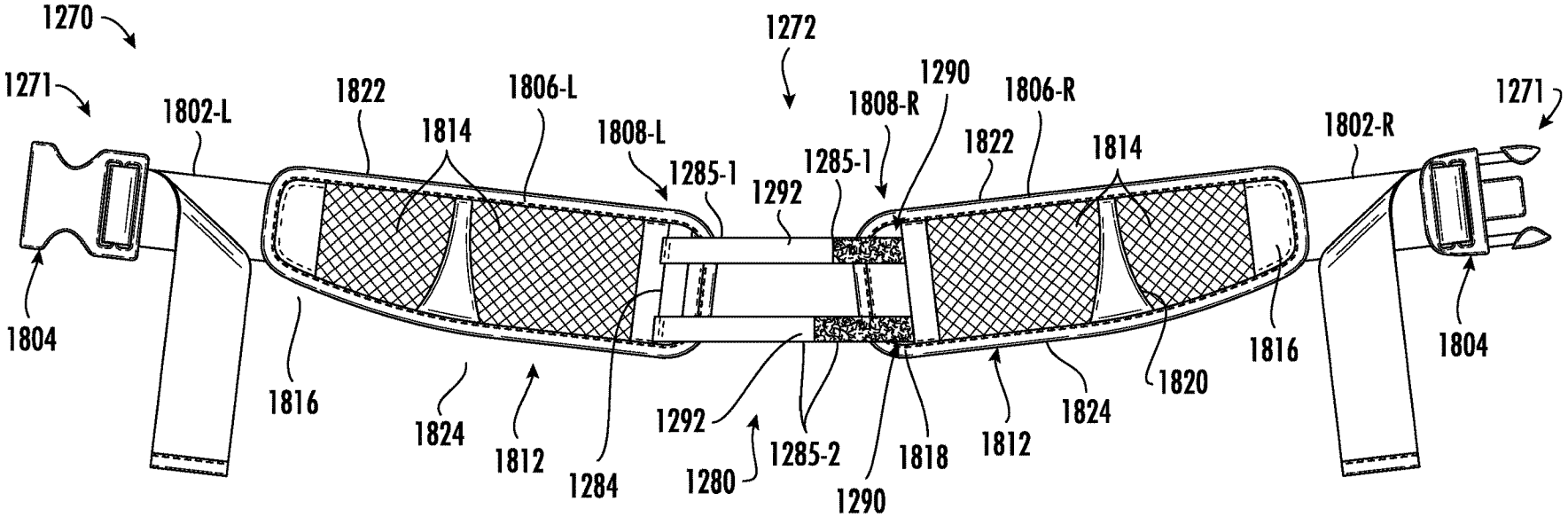
FIG. 51 is a rearview of an example hip belt of the backpack of FIG. 38 illustrating side panels of the example hip belt at a second angle.
Figure 52:
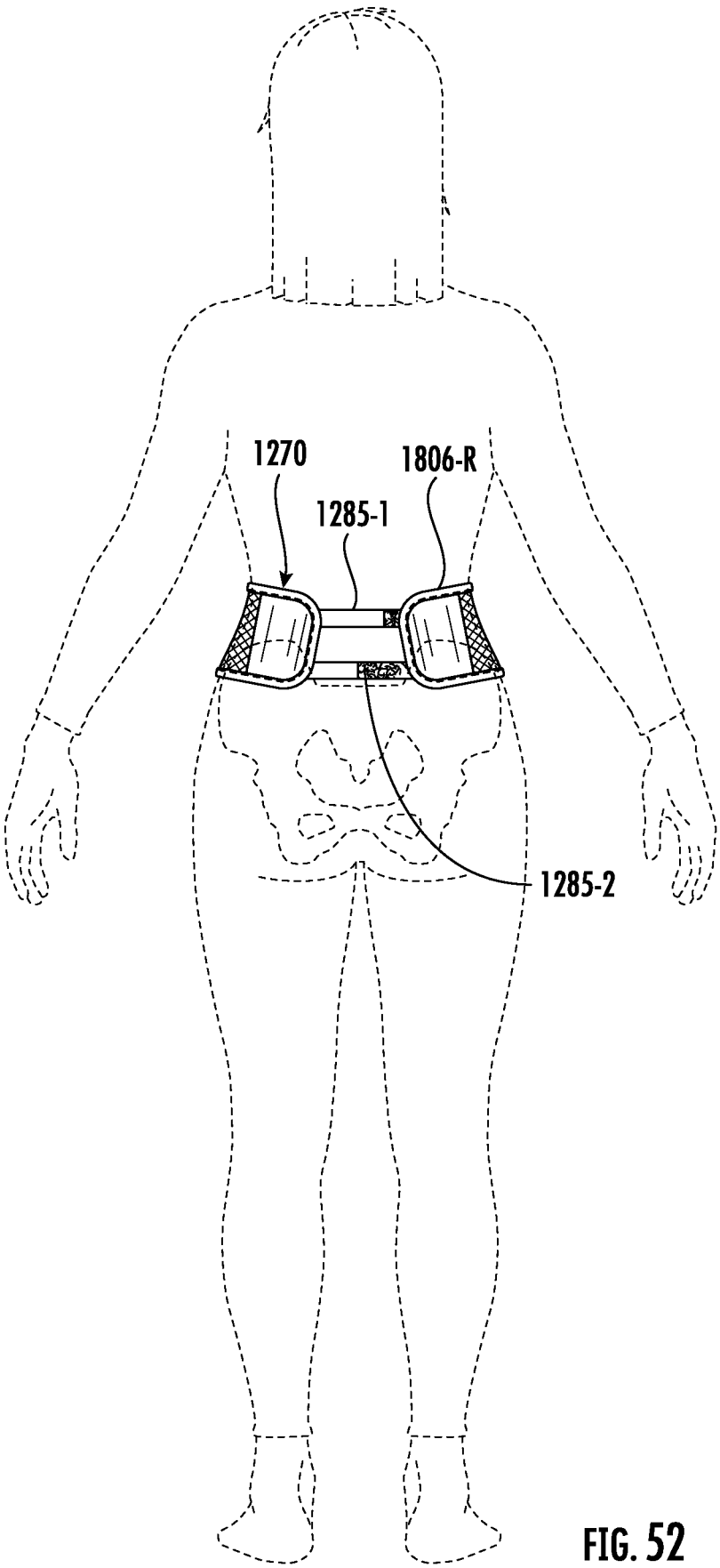
FIG. 52 is a rearview of the example hip belt of FIG. 51 being worn by an example person.

FIG. 51 illustrates an example where a greater extent or length of strap 1285-1 is wrapped or turned about turn bar 1284 greater than the extent to which strap 1285-2 is wrapped about turn bar 1284. As a result, rear end portions 1808 and side panels 1806 are not coaxial and are retained at selected upward angles relative to one another to accommodate steeper iliac crests as shown in FIG. 52.

Figure 53:
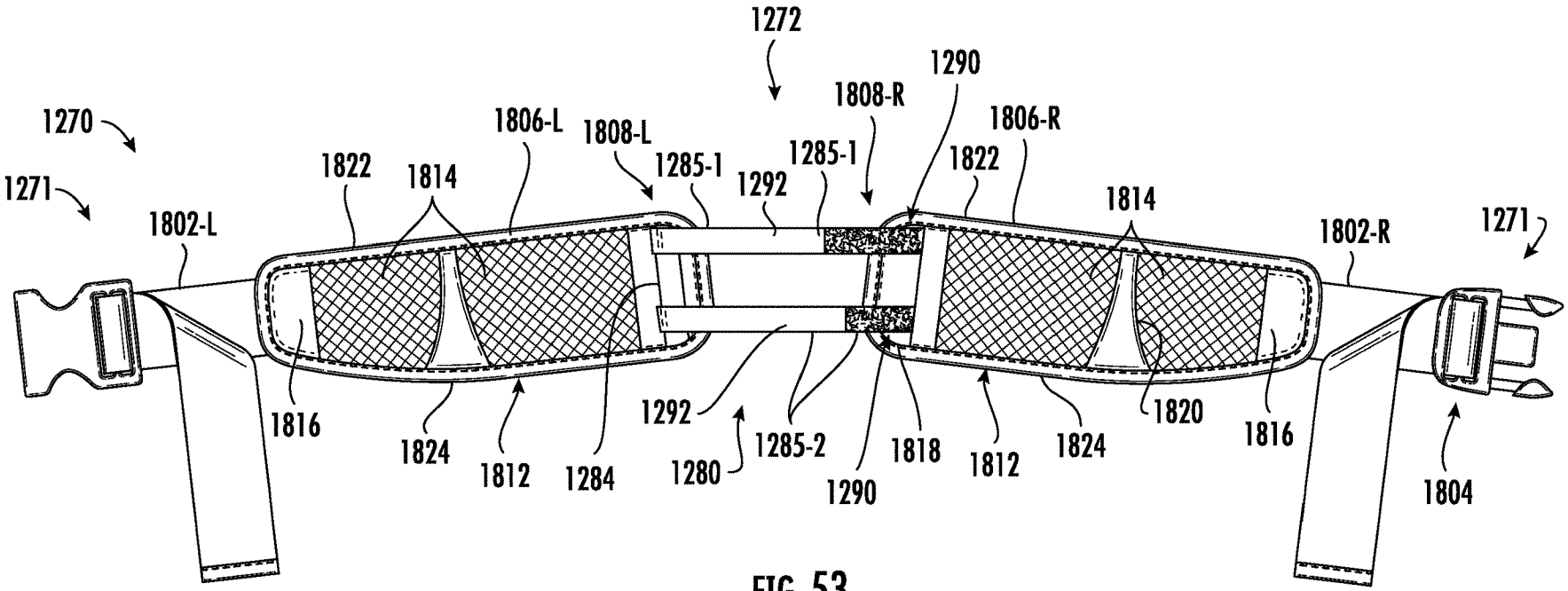
FIG. 53 is a rearview of an example hip belt of the backpack of FIG. 38 illustrating side panels of the example hip belt at a third angle.

FIG. 53 illustrates an example of where a greater extent or length of strap 1285-2 is wrapped or turned about turn bar 1284, greater than the extent to which strap 1285-1 is wrapped about turn bar 1284. As a result, rear end portions 1808 and side panels 1806 are not coaxial and are retained at selected downward angles relative to one another to accommodate other particular iliac crest heights.

Figure 54:
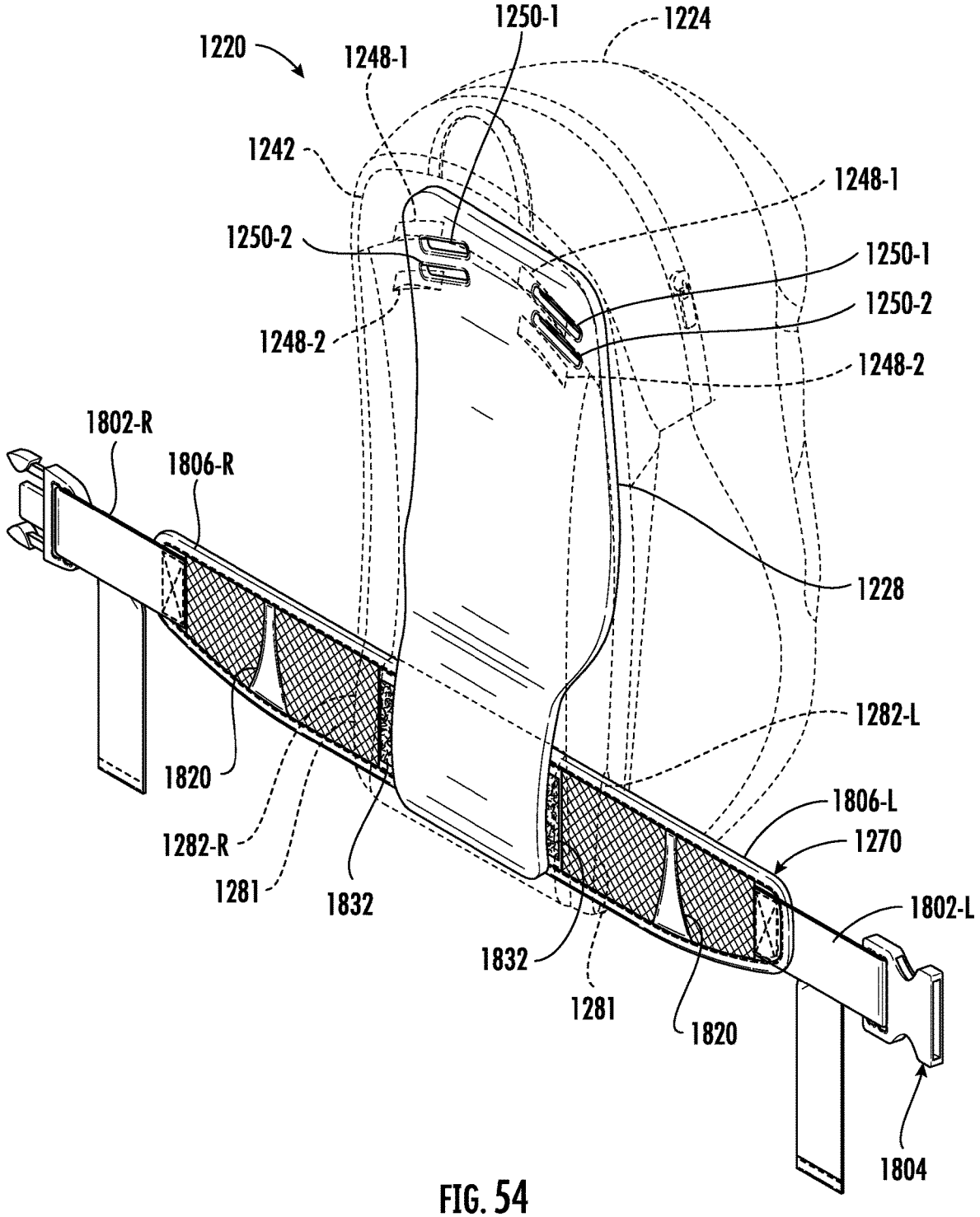
FIG. 54 is a perspective view of the example backpack of FIG. 38.
Figure 55:
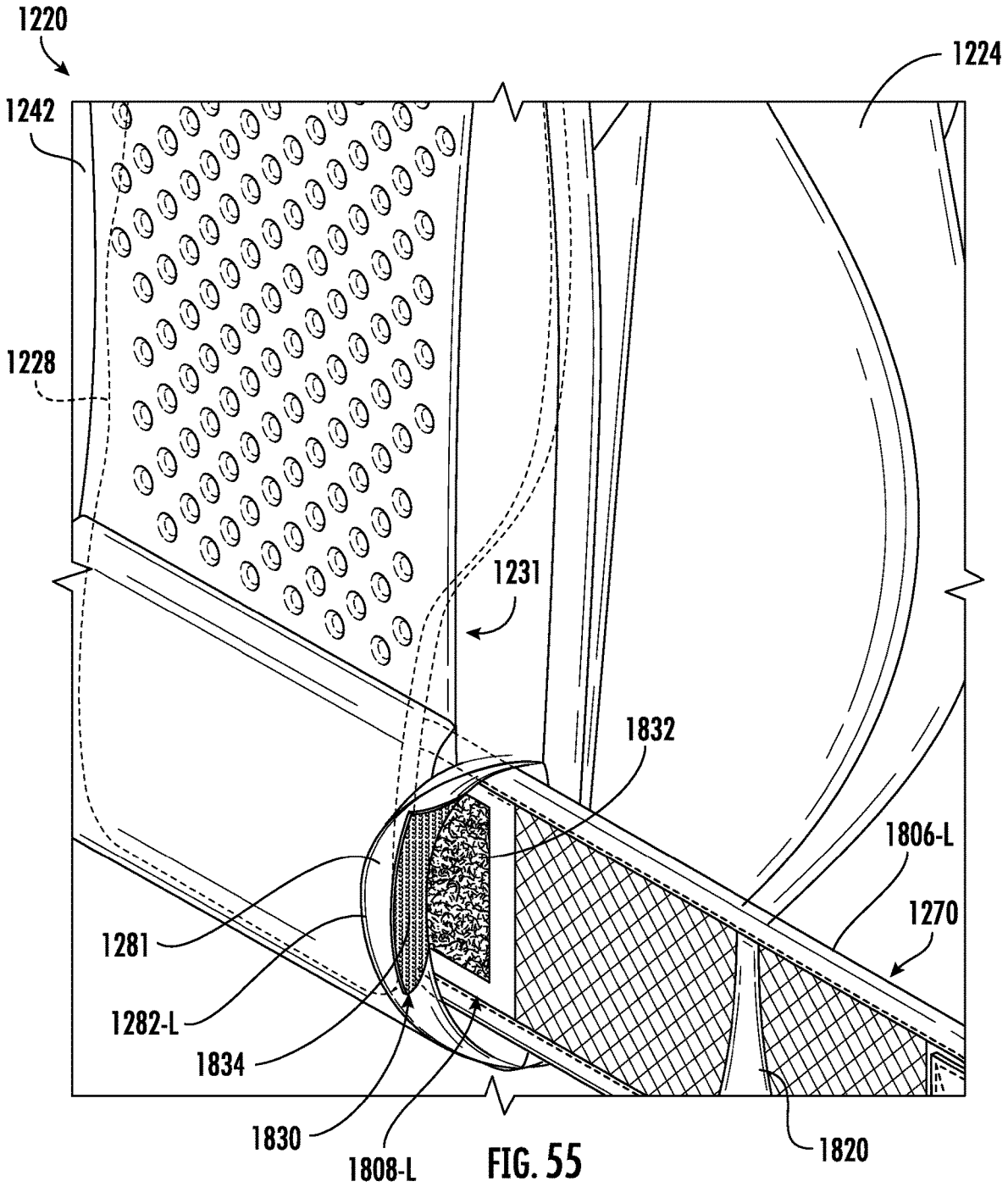
FIG. 55 is an enlarged fragmentary perspective view of the example backpack of FIG. 54 illustrating releasable connection of the hip belt to an interior of an example sleeve of the example backpack.

As shown by FIGS. 39, 54 and 55, backpack 1220 additionally comprises sleeve 1281. Sleeve 1281 is located on side 1231 of frame 228 (shown in FIG. 45), being located or sandwiched between frame 1228 and the interior of pack portion 1224. Sleeve 1281 comprises mouths or slots 1282-R and 1282-L (collectively referred to as slots 1282) at opposite lateral sides of sleeve 1281. Slots 1282 have lengths or heights) sufficient to accommodate the different angular positions of end portions 1808. Sleeve 1281 removably receives end portions 1808 of hip belt 1270, facilitating separation of hip belt 1270 from pack portion 1224. Sleeve 1281 further covers and protects end portions 1808 and angle retainer 1280. Sleeve 1281 may reduce the likelihood of angle retainer 1280 catching upon an external object or being inadvertently loosened to allow inadvertent changes to the angles of end portions 1808 or of side panels 1806.

Sleeve 1281 is connected to frame 1228. In some implementations, sleeve 1281 comprises one or more panels forming an uninterrupted tube, wherein the tube is coupled to frame 1228, directly or indirectly. For example, in some implementations, sleeve 1281 may be stitched, welded, fastened or otherwise attached to frame 1228. In some implementations, sleeve 1281 may be formed by joining opposite edges of a panel directly to frame 1228, wherein frame 1228 forms one side of the sleeve interior.

As shown by FIG. 55, rear end portions 1808 may be releasably attached to sleeve 1281 and/or to frame 1228 while within sleeve 1281 such that loads may be transmitted from frame 1228 to hip belt 1270. In the example illustrated, rear end portions 1808 are releasably attached to the interior of sleeve 1281 by hook and loop fastener 1830. One or both of end portions 1808 may be provided with a first patch 1832 providing one component of a hook and loop fastener 1830 (hooks or loops) while sleeve 1281 and/or side 1231 of frame 1228 is provided with a second patch 1834 providing the other component of the hook and loop fastener 1830 (loops or hooks). In implementations where the other component of the hook and loop fastener 1830 is provided as a patch adhered to side 1231 of frame 1228, the gusset receiving frame 1228 may include an opening to expose the patch on frame 1228 to the interior of the sleeve 1281, facilitating to direct connection between patch 1832 and the patch 1834 provided on frame 1228. In yet other implementations, end portions 1808 may be releasably attached to sleeve 1281 and/or frame 1228 by snap fasteners (described above) or other attachment mechanisms.

Although the present disclosure has been described with reference to example implementations, workers skilled in the art will recognize that changes may be made in form and detail without departing from the disclosure. For example, although different example implementations may have been described as including features providing various benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A backpack comprising:

a pack portion made a flexible material and comprising a backside and an inner compartment to accommodate a load to be carried during use of the backpack, the backside comprising a slot;

a frame connected to pack portion between the backside and the inner compartment, the frame comprising at least a rigid or semi rigid sheet, the sheet being more rigid than the flexible material of the pack portion, the sheet comprising an opening; and a shoulder strap comprising a flexible end portion passing through the first slot and the opening and adjustably connected to the frame to adjust a length of the flexible end portion of the shoulder strap that extends beyond the first slot, wherein the flexible end portion is releasably connected to the rigid or semi-rigid sheet at one of a plurality of available connection locations to adjust an angle at which the flexible end portion extends parallel to the rigid or semi-rigid sheet from the rigid or semi-rigid sheet to the opening.

2. The backpack of claim 1, further comprising a first length of a first portion of a hook and loop fastener connected to the sheet and a flexible second length of a second complementary flexible portion of the hook and loop fastener connected to the flexible end portion of the shoulder strap.

3. The backpack of claim 1 further comprising a gusset pocket formed between the backside and the inner compartment, the gusset pocket receiving the rigid or semi rigid sheet.

4. The backpack of claim 1, wherein the flexible end portion of the shoulder strap has a first length extending beyond the slot and a second length passing through the slot and the opening.

5. The backpack of claim 1 further comprising a load stabilizing strap having a lower end connected to the shoulder strap and an upper end connected to the backside of the pack portion.

6. The backpack of claim 1 further comprising a maximum extension indicator indicating a recommended maximum extent to which the flexible end portion may extend beyond the slot, wherein the maximum extension indicator is formed on the frame.

7. The backpack of claim 1 further comprising an extension stop provided on the flexible end portion of the shoulder strap and located between the sheet and the inner compartment, the extension stop being configured to resist movement of the extension stop through the opening.

8. The backpack of claim 1, wherein the backside of the pack portion comprises a second slot below the slot, wherein the sheet comprises a second opening aligned with the second slot and vertically spaced from the opening, and wherein the flexible end portion of the shoulder strap is configured to be withdrawn from the slot and the opening and is configured to be passed through the second slot and the second opening into adjustable connection to the frame to adjust a length of the flexible end portion of the shoulder strap that extends beyond the second slot.

9. The backpack of claim 1, further comprising a first portion of a hook and loop fastener connected to the sheet and a second complementary flexible portion of the hook and loop fastener connected to the flexible end portion of the shoulder strap, wherein the flexible end portion of the shoulder strap is connectable to the sheet at one of a plurality of available connection locations to adjust the angle at which the flexible end portion extends parallel to the frame from the frame to the second slot.

10. The backpack of claim 9, wherein the flexible end portion of the shoulder strap longitudinally extends to a terminal end and has a maximum transverse width and wherein the first portion of the hook and loop fastener has a transverse width greater than the maximum transverse width of the flexible end portion.

11. The backpack of claim 10 further comprising a second shoulder strap comprising a second flexible end portion adjustably connected to the frame independent of flexible end portion of the shoulder strap, the second flexible end portion longitudinally extending to a second terminal end, the second flexible end portion has a second maximum transverse width, wherein the transverse width of the first portion of the hook and loop fastener connected to the sheet is greater than the sum of the maximum transverse width of the flexible end portion and the second maximum transverse width of the second flexible end portion.

12. The backpack of claim 11, wherein the first portion of the hook and loop fastener connected to the rigid or semi rigid sheet comprises a first patch connected to the rigid or semi rigid sheet and a second patch connected to the rigid or semi rigid sheet.

13. The backpack of claim 12 further comprising:

a first flap pivotably coupled to the frame below the first patch of the hook and loop fastener, the first flap comprising a third portion of a hook and loop fastener complementary to the first portion of the hook loop fastener of the first patch; and a second flap pivotably coupled to the frame below the second patch of the hook and loop fastener on a second side of the stay, the second flap comprising a fourth portion of a hook and loop fastener complementary to the first portion of the hook and loop fastener of the second patch.

14. The backpack of claim 11, wherein the first portion of the hook and loop fastener connected to the rigid or semi rigid sheet comprises a single continuous patch.

15. The backpack of claim 14 further comprising a stay removably coupled to and longitudinally extending along the rigid or semi rigid sheet, wherein the single continuous patch of the hook and loop fastener continuously extends transversely across the stay with the stay being sandwiched between the single continuous patch and the rigid or semi rigid sheet.

16. The backpack of claim 15 further comprising a flap pivotably coupled to the frame below the single continuous patch of the hook and loop fastener, the flap continuously extending transversely across the stay, the flap being pivotable to a position in which the flexible end portion of the shoulder strap and the second flexible end portion of the second shoulder strap are both sandwiched between the flap and the rigid or semi rigid sheet, the flap comprising a third portion of a hook and loop fastener complementary to the first portion of the hook and loop fastener of the single continuous patch.

17. The backpack of claim 16, wherein a free end of the flap is releasably connectable to the rigid or semi rigid sheet below the single continuous patch of the hook and loop fastener.

18. The backpack of claim 14 further comprising:

a first flap pivotably coupled to the frame below the single continuous patch of the hook and loop fastener on a first side of the stay, the first flap comprising a third portion of a hook and loop fastener complementary to the first portion of the hook loop fastener of the single continuous patch; and a second flap pivotably coupled to the frame below the single continuous patch of the hook and loop fastener on a second side of the stay, the second flap comprising a fourth portion of a hook and loop fastener complementary to the first portion of the hook and loop fastener of the single continuous patch.

* * * * *